US006884146B2

(12) United States Patent
Lehman et al.

(10) Patent No.: US 6,884,146 B2
(45) Date of Patent: Apr. 26, 2005

(54) SYSTEMS AND METHODS FOR CHARACTERIZING A POLISHING PROCESS

(75) Inventors: Kurt Lehman, Menlo Park, CA (US); Charles Chen, Sunnyvale, CA (US); Ronald L. Allen, San Jose, CA (US); Robert Shinagawa, Cupertino, CA (US); Anantha Sethuraman, Palo Alto, CA (US); Christopher F. Bevis, Los Gatos, CA (US); Thanassis Trikas, Redwood City, CA (US); Haiguang Chen, Millbrae, CA (US); Ching Ling Meng, Fremont, CA (US)

(73) Assignee: KLA-Tencor Technologies Corp., Milpitas, CA (US)

( * ) Notice: Subject to any disclaimer, the term of this patent is extended or adjusted under 35 U.S.C. 154(b) by 0 days.

(21) Appl. No.: 10/358,105

(22) Filed: Feb. 4, 2003

(65) Prior Publication Data

US 2003/0181131 A1 Sep. 25, 2003

Related U.S. Application Data

(60) Provisional application No. 60/354,179, filed on Feb. 4, 2002.

(51) Int. Cl.[7] ..... B24D 49/00

(52) U.S. Cl. ..... 451/5; 451/6; 451/8; 451/9; 451/41; 451/285; 451/286; 451/287; 451/288; 438/14; 438/15; 438/16; 438/17

(58) Field of Search ..... 451/5, 6, 8, 9, 451/41, 285, 286, 287, 288; 438/14, 15, 16, 17

(56) References Cited

U.S. PATENT DOCUMENTS

| | | | |
|---|---|---|---|
| 4,369,284 | A | 1/1983 | Chen |
| 4,618,213 | A | 10/1986 | Chen |
| 4,926,489 | A | 5/1990 | Danielson et al. |
| 5,486,701 | A | 1/1996 | Norton et al. |
| 5,552,704 | A | 9/1996 | Mallory et al. |
| 5,575,598 | A | 11/1996 | Abe et al. |
| 5,730,642 | A | 3/1998 | Sandhu et al. |
| 5,747,813 | A | 5/1998 | Norton et al. |
| 5,795,688 | A | 8/1998 | Burdorf et al. |
| 5,872,633 | A | 2/1999 | Holzapfel et al. |

(Continued)

FOREIGN PATENT DOCUMENTS

| | | |
|---|---|---|
| EP | 0 628 806 | 12/1994 |
| EP | 1 022 093 | 7/2000 |
| EP | 1 066 925 | 1/2001 |
| EP | 1 081 489 | 3/2001 |
| EP | 1 093 017 | 4/2001 |
| WO | 99/22310 | 5/1999 |
| WO | 99/23449 | 5/1999 |
| WO | 99/25044 | 5/1999 |

(Continued)

*Primary Examiner*—Joseph J. Hail, III
*Assistant Examiner*—Shantese L. McDonald
(74) *Attorney, Agent, or Firm*—Ann Marie Mewhetter; Daffer McDaniel, LLP

(57) ABSTRACT

Systems and methods for characterizing a polishing process are provided. One method includes scanning a specimen with two or more measurement devices during polishing. In one embodiment, the two or more measurement devices may include a reflectometer and a capacitance probe. In another embodiment, the two or more measurement devices may include an optical device and an eddy current device. An additional embodiment relates to a measurement device for scanning a specimen during polishing. The device includes a light source and a scanning assembly. The scanning assembly is configured to scan light from the light source across the specimen during polishing. Another measurement device includes a laser light source coupled to a first fiber optic bundle and a detector coupled to a second fiber optic bundle. An additional method includes scanning a specimen with different measurement devices during different steps of a polishing process.

39 Claims, 14 Drawing Sheets

U.S. PATENT DOCUMENTS 5,893,796 A 4/1999 Birang et al.
5,904,609 A 5/1999 Fukuroda et al.
5,964,643 A 10/1999 Birang et al.
5,970,168 A 10/1999 Montesanto et al.
5,991,699 A 11/1999 Kulkarni et al.
6,012,966 A 1/2000 Ban et al.
6,045,433 A 4/2000 Dvir et al.
6,045,439 A 4/2000 Birang et al.
6,104,835 A 8/2000 Han
6,146,259 A 11/2000 Zuniga et al.
6,159,073 A 12/2000 Wiswesser et al.
6,171,181 B1 1/2001 Roberts et al.
6,179,709 B1 1/2001 Redeker et al.
6,231,434 B1 5/2001 Cook et al.
6,247,998 B1 6/2001 Wiswesser et al.
6,254,459 B1 7/2001 Bajaj et al.
6,257,953 B1 * 7/2001 Gitis et al. ..... 451/5
6,280,290 B1 8/2001 Birang et al.
6,282,309 B1 8/2001 Emery
6,328,872 B1 12/2001 Talich et al.
6,433,541 B1 8/2002 Lehman et al.
6,529,621 B1 3/2003 Glasser et al.
6,549,006 B1 * 4/2003 Le ..... 324/230
6,602,724 B1 * 8/2003 Redeker et al. ..... 438/5
6,614,520 B1 9/2003 Bareket et al.
6,628,397 B1 9/2003 Nikoonahad et al.
6,630,995 B1 * 10/2003 Hunter ..... 356/237.5
6,636,301 B1 10/2003 Kvamme et al.
6,671,051 B1 12/2003 Nikoonahad et al.
6,673,637 B1 * 1/2004 Wack et al. ..... 438/14
6,707,540 B1 3/2004 Lehman et al.

FOREIGN PATENT DOCUMENTS

WO 99/45340 9/1999
WO 00/00873 1/2000
WO 00/00874 1/2000
WO 00/18543 4/2000
WO 00/26609 5/2000
WO 00/26613 5/2000
WO 00/36525 6/2000
WO 00/68884 11/2000
WO 00/70332 11/2000
WO 01/40145 6/2001
WO 01/80304 10/2001

* cited by examiner

SYSTEMS AND METHODS FOR CHARACTERIZING A POLISHING PROCESS

PRIORITY CLAIM

This application claims priority to U.S. Provisional Application No. 60/354,179 entitled "Systems and Methods for Characterizing a Polishing Process," filed Feb. 4, 2002.

BACKGROUND OF THE INVENTION

1. Field of the Invention

The present invention generally relates to systems and methods for characterizing a polishing process. Certain embodiments relate to systems and methods for evaluating optical and/or eddy current data obtained during polishing of a specimen to determine a characteristic of the polishing process.

2. Description of the Related Art

The following descriptions and examples are not admitted to be prior art by virtue of their inclusion within this section.

Fabricating semiconductor devices such as logic and memory devices may typically include processing a specimen such as a semiconductor wafer using a number of semiconductor fabrication processes to form various features and multiple levels of the semiconductor devices. For example, insulating (or dielectric) materials may be formed on multiple levels of a substrate using deposition processes such as chemical vapor deposition ("CVD"), physical vapor deposition ("PVD"), and atomic layer deposition ("ALD"). Such insulating materials may electrically isolate conductive structures of a semiconductor device formed on the substrate. For example, the insulating materials may be used to form an interlevel dielectric or shallow trench isolation regions. Conductive materials may also be formed on a substrate using the deposition processes described above. In addition, conductive materials may also be formed on a substrate using a plating process. Chemical-mechanical polishing ("CMP") may typically be used in the semiconductor industry to reduce elevational disparities or to planarize layers of such materials on a specimen. Additional examples of semiconductor fabrication processes may include, but are not limited to, lithography, etch, ion implantation, and cleaning. Multiple semiconductor devices may be fabricated in an arrangement on a semiconductor wafer and then separated into individual semiconductor devices.

Characterizing, monitoring, and/or controlling such semiconductor fabrication processes is an important aspect of semiconductor device manufacturing. A number of techniques are presently available for such characterizing, monitoring, and/or controlling. For example, one presently available method to control a CMP process for shallow trench isolation is a polishing-time based method, which uses a fixed polishing time determined from polishing results of test, or monitor, wafers. In situ end point detection methods based on motor current and carrier vibration techniques are also currently available. In addition, post-CMP in-tool film thickness measurements are currently used.

There are, however, several disadvantages to such currently available methods for characterizing, monitoring, and/or controlling a CMP process. For example, in a CMP process, many variable parameters such as pad condition, slurry chemistry, incoming wafer film thickness, and circuit pattern density may affect the required polishing time. The polishing-time based method may not effectively handle these changes in the polishing conditions, and thus often produces over-polished or under-polished results. In addition, measuring monitor wafers reduces production throughput and thus overall equipment efficiency. Motor current and carrier vibration endpoint detection methods may not provide planarization information in different wafers areas and may not be effective for a shallow trench isolation (STI) process.

Currently available methods for characterizing, monitoring, and/or controlling a CMP process may also include ex situ and in situ endpoint detection methods. Ex situ methods include analyzing the wafer surface after a polishing process has finished. For example, such analyzing may include removing the wafer from the polishing chamber and loading the wafer in a metrology system. In situ methods include indirect methods such as slurry byproduct monitoring and methods described above such as motor current monitoring and carrier head vibration monitoring. One currently available in situ direct method uses an eddy current-based proximity sensor. The eddy current sensor provides a relative indication of thick metal films such as copper by sensing only the in-phase component of the induced eddy current.

There are also, however, several disadvantages to currently available ex situ methods for characterizing, monitoring, and/or controlling a CMP process. For example, CMP tool throughput may be reduced due to ex situ endpointing systems because the wafer must be removed from the process tool, analyzed, and marginalities of its polishing must be resolved before the next wafer can be polished. Ex situ methods are also more problematic due to the difficulty of resuming CMP processing of a wafer that is underpolished. Furthermore, ex situ methods are even more problematic because over-polishing of wafers cannot be actively prevented, only reported after the fact. Therefore, ex situ process control methods may suffer from a high scrapped wafer rate.

In addition, there are several disadvantages to currently available in situ methods for characterizing, monitoring, and/or controlling a CMP process. For example, in situ, indirect methods provide no local information on films. Therefore, local information often has to be determined by ex situ spot checking of the wafers. Moreover, indirect monitoring makes process tuning more difficult. In addition, indirect methods are feasible only with certain polishing pads, slurries, speeds, and pressure settings. Therefore, these constraints limit the options for CMP processes. Sometimes such constraints may translate into diminished throughput and polish quality. Currently available in situ direct methods that use eddy current-based sensors but report only a relative thickness value are known in the art, but a relative process variable is difficult to incorporate into a recipe for transport between process tools. Moreover, these devices do not compensate for temperature changes that may affect the sensor output.

Currently available methods for whole-wafer measurements of thickness, typically, do not provide spatial resolution. For example, some currently available methods use a fixed sensor such as a sensor mounted on a shaft of a table supporting the wafer. Therefore, such sensors can only measure one location of the wafer (i.e., the center spot). Such methods may provide relatively poor performance because the entire wafer does not polish at the same rate as the observed spot.

In rotary platen/rotary carrier machines, sensors may be fixed off-center under the platen to sweep the wafer as the table rotates. Depending upon the ratio of the rotational speeds of the platen and the carrier, the sensor path over the wafer may be different with each sweep. Such methods process the measurements within annular zones on the wafer. Therefore, although such methods correlate the measurements to a radial location with respect to the wafer center, the measurements are not correlated to an angular location. As such, these techniques provide no method by which to associate a specific spatial location on the wafer with a specific measurement. For example, data processing on a control computer may indicate that a certain zone was polished too long. This means that CMP defects such as dishing and erosion are likely to be present in this annular zone. The data processing, however, does not determine where this region lies, except that it is a given distance from the wafer center. Therefore, annular-zone based measurements provide limited spatial resolution based on the sensor's distance from the wafer center. Examples of such methods are illustrated in U.S. Pat. No. 5,893,796 to Birang et al., U.S. Pat. No. 5,964,643 to Birang et al., U.S. Pat. No. 6,045,439 to Birang et al., U.S. Pat. No. 6,159,073 to Wiswesser et al., and U.S. Pat. No. 6,280,290 to Birang et al., which are incorporated by reference as if fully set forth herein.

In some CMP system configurations, such information may be passed to another control computer which continues the wafer planarization on another platen with different process parameters. However, the annular zone-based information may not be useful since the angular orientation of the wafer is lost in the transfer to the platen used in the second step. A program of the second control computer may regenerate a full wafer map of surface film features on the wafer, but in the time required to regenerate the map, the wafer may be damaged by over-polishing while these complicated algorithms execute.

SUMMARY OF THE INVENTION

An embodiment of the invention relates to a method for detecting a presence of blobs on a specimen. The method may include scanning measurement spots in a line across the specimen during polishing of the specimen. The method may also include determining if blobs are present on the specimen at the measurement spots. Each of the blobs may include unwanted material disposed upon a contiguous portion of the measurement spots. A height of the blobs may vary across the contiguous portion of the measurement spots. The contiguous portion of the measurement spots may have a lateral dimension within a predetermined range of lateral dimensions. The blobs may include copper.

Scanning the measurement spots may include measuring an optical property of the specimen at the measurement spots. In an embodiment, scanning the measurement spots may include measuring optical reflectivity of the specimen at the measurement spots. Alternatively, scanning the measurements may include measuring an electrical property of the specimen at the measurement spots. For example, scanning the measurement spots may include measuring an electrical property of the specimen at the measurement spots with an eddy current device. In addition, scanning the measurement spots may include measuring an optical property such as reflectivity and an electrical property of the specimen at the measurement spots.

In an embodiment, the method may further include dynamically determining a signal threshold distinguishing a presence of the blobs from an absence of the blobs. In such an embodiment, determining if the blobs are present on the specimen may include comparing output signals generated by scanning of the measurement device to the signal threshold to determine if a portion of a blob is present on the measurement spots. In an embodiment, the method may include determining an endpoint of polishing if blobs are not determined to be present on the specimen. The method may also include altering a parameter of the polishing in response to determining an approximate endpoint such that the measurement spots may extend across an area approximately equal to an area of the specimen. For example, a speed of the polishing may be reduced in response to determining the approximate endpoint. The parameter of the polishing may also be altered in response to determining the approximate endpoint to reduce dishing and/or erosion of the specimen.

In alternative embodiments, the method may also be performed during other processes. For example, the method may be performed during a process including, but not limited to, removing material from the specimen, etching the specimen, and cleaning the specimen.

An additional embodiment relates to a system configured to detect a presence of blobs on a specimen. The system may include a measurement device configured to scan measurement spots in a line across the specimen during a polishing process. In alternative embodiments, the measurement device may be configured to scan measurement spots across the specimen during a process such as removing material from the specimen, etch, and cleaning. The system may also include a processor coupled to the measurement device. The processor may be configured to determine if blobs are present on the specimen at the measurement spots. In an embodiment, the processor may also be configured to dynamically determine a signal threshold as described herein. In a further embodiment, the processor may be configured to determine an endpoint of the polishing as described herein.

In an embodiment, the measurement device may include an optical device such as a reflectometer. The measurement device may include a scanning laser assembly. The scanning laser assembly may include a mechanical scanner or an acousto-optical device. In an alternative embodiment, the measurement device may include an electrical measurement device such as an eddy current device. The measurement device may further include a capacitance probe or a conductive polymer probe. In a further embodiment, the measurement device may include an optical device and an eddy current device.

A further embodiment relates to a method for characterizing polishing of a specimen. The method may include scanning the specimen with an eddy current device during polishing to generate output signals at measurement spots across the specimen. The method may also include combining a portion of the output signals generated at measurement spots located within a zone on the specimen. The zone may include a predetermined range of radial and azimuthal positions on the specimen. The measurement spots within the zone may have radial and azimuthal positions on the specimen within the predetermined range. In addition, the method may include determining the characteristic of polishing within the zone from the combined portion of the output signals.

In an embodiment, the method may include altering a parameter of polishing within the zone in response to the characteristic of polishing within the zone. In this manner, within specimen variation of the characteristic may be reduced. In an additional embodiment, the method may include determining a characteristic of polishing within the zone and an additional zone on the specimen. Such an embodiment may also include altering a parameter of polishing in response to the characteristics of polishing within the zone and the additional zone. As such, the parameter in the zone may be different than the parameter in the additional zone. In a further embodiment, the method may include generating a two-dimensional map of the characteristic within the zone. Such a method may also include altering a parameter of polishing in response to the map. The method may also include altering a parameter of polishing in response to the map using an in situ control technique. An additional embodiment may include detecting a presence of blobs on the specimen as described herein. The blobs may be located across adjacent zones on the specimen.

In alternative embodiments, the method may also be performed during other processes. For example, the method may be performed during a process including, but not limited to, removing material from the specimen, an etch process, a cleaning process, a deposition process, and a plating process.

A further embodiment relates to a system configured to characterize a polishing process. Systems, as described herein, may be configured to characterize other processes including, but not limited to, removing material from the specimen, an etch process, a cleaning process, a deposition process, and a plating process. The system may include an eddy current device configured to scan a specimen during the polishing process to generate output signals at measurement spots across the specimen. The system may also include a processor coupled to the eddy current device. The processor may be configured to combine a portion of the output signals generated at measurement spots located within a zone on the specimen. As described above, the zone may include a predetermined range of radial and azimuthal positions on the specimen. The measurement spots within the zone may have radial and azimuthal positions on the specimen within the predetermined range. The processor may also be configured to determine the characteristic of the polishing process within the zone from the combined portion of the output signals.

In an embodiment, the processor may be configured to alter a parameter of polishing within the zone in response to the characteristic of polishing within the zone. In this manner, within specimen variations of the characteristic may be reduced. In an additional embodiment, the processor may be configured to determine a characteristic of polishing within the zone and a characteristic of polishing within an additional zone on the specimen. Such a processor may also be configured to alter a parameter of polishing in the zone and the additional zone in response to the characteristics of polishing within the zone and the additional zone, respectively. In this manner, the parameter in the zone may be different than the parameter in the additional zone. In a further embodiment, the processor may be configured to generate a two-dimensional map of the characteristic within the zone. Such a processor may also be configured to alter a parameter of polishing in response to the map. The processor may also be configured to alter a parameter of polishing in response to the map using an in situ control technique. In addition, the processor may be configured to detect a presence of blobs on the specimen as described herein. The blobs may be located across adjacent zones on the specimen.

An additional embodiment relates to a window configured to be coupled to a process tool. For example, the window may be disposed within an opening in a polishing pad. The window may include a first portion formed of a first material. The window may also include a second portion. The second portion may be formed of a second material different than the first material. In an embodiment, the first material may be substantially transparent. In addition, the second material may also be substantially transparent. Furthermore, the first and second materials may be substantially transparent to more than one wavelength of light. In this manner, the window may be coupled to a measurement device that includes a spectroscopic light source such as a spectroscopic reflectometer. In an embodiment, the second material may be a gel. The second material may include a triblock copolymer having a general configuration of poly(styrene-ethylene-butylene-styrene) and a plasticizing oil. In addition, the second material may be a gelatinous elastomer. In contrast, the first material may be formed of, for example, polyurethane.

A further embodiment relates to a window configurable to be coupled to a process tool such as a polishing tool. The window may be formed of a substantially transparent gel. For example, substantially the entire window may be formed of the substantially transparent gel. In an embodiment, the gel may be substantially transparent to more than one wavelength of light. The gel may include a triblock copolymer and a plasticizing oil as described herein. The gel may be an elastomer. The gel may be configured to compress in response to a pressure on an upper surface of the window. In an embodiment, the window may also include a membrane surrounding the gel. The membrane may be formed of a material such as polyurethane.

An additional embodiment relates to a window configurable to be coupled to a process tool. For example, the window may be disposed within an opening in a polishing pad. The window may include an upper window. The upper window may be formed of polyurethane. The window may also include a housing coupled to the upper window. The housing may be configured such that a gap is disposed in the opening between upper surfaces of the housing and a lower surface of the upper window. In addition, the window may include a diaphragm coupled to the housing. The diaphragm may be disposed in the gap. The housing may be configured to allow a fluid to flow into and out of a space between the upper surfaces of the housing and the diaphragm. The fluid may include water. In an embodiment, the upper window, the housing, and the diaphragm may be formed of substantially transparent materials. In addition, the upper window, the housing, and the diaphragm may be formed of materials that are substantially transparent to more than one wavelength of light.

Another embodiment relates to a window configurable to be coupled to a process tool such as a polishing tool. A layer of material may be coupled to lateral surfaces of the window. A thickness of the layer of material may be substantially less than a thickness of the window. For example, a thickness of the layer may be less than about 15 mm. In an embodiment, the layer of material may be formed of a triblock copolymer and a plasticizing oil as described herein. The layer of material may include an elastomer. Movement of the window may compress the layer of material. In addition, the layer of material may be configured to compress in response to a pressure applied to an upper surface of the window.

An additional embodiment relates to a measurement device configurable to be coupled to a polishing pad. The measurement device may include a light source configurable to direct light through a portion of the polishing pad. A wavelength of the directed light may be selected in response to a characteristic of the polishing pad. In addition, the measurement device may include a collector configurable to collect light returned through the polishing pad. In an embodiment, the polishing pad may include a top pad and a sub pad. The top pad may be configured to contact a specimen during polishing. An opening may be formed through the sub pad. In such an embodiment, the measurement device may be configured to direct light through a portion of the top pad above the opening. In addition, the measurement device may be configured to collect light returned through the portion of the top pad during polishing.

A further embodiment relates to another measurement device configurable to be coupled to a polishing pad. The measurement device may include a light source configurable to direct two beams of light through a portion of the polishing pad. One of the two beams of light may include a reference beam of light responsive to a characteristic of the polishing pad. The measurement device may also include a collector configurable to collect the two beams of light returned through the portion of the polishing pad. In an embodiment, the polishing pad may include a top pad and a sub pad that may be configured as described herein. In such an embodiment, the measurement device may be configured to direct the two beams of light through a portion of the top pad above an opening in the sub pad during polishing. In addition, the measurement device may be configured to collect the two beams of light returned from the specimen through the portion of the top pad during polishing.

Another embodiment relates to a method for characterizing polishing of a specimen. The method may include scanning the specimen with a measurement device during polishing to generate output signals at measurement spots on the specimen. The method may also include determining a characteristic of polishing at the measurement spots from the output signals. In addition, the method may include determining relative locations of the measurement spots on the specimen. In an embodiment, determining the relative locations may include determining the relative locations of the measurement spots on the specimen from a representative scan path of the measurement device and an average spacing between starting points of individual scans of the measurement device. The method may further include generating a two-dimensional map of the characteristic at the relative locations of the measurement spots on the specimen. The two-dimensional map may be generated using polar coordinates of the relative locations or Cartesian coordinates of the relative locations.

In an embodiment, the two-dimensional map may be generated as polishing proceeds. In this manner, the two-dimensional map may illustrate changes in the characteristic at the relative locations of the measurement spots as polishing proceeds. In another embodiment, the method may include scanning the specimen as described herein until a predetermined thickness of a film is detected on the specimen. Subsequent to detecting the predetermined thickness, the specimen may be scanned with a different measurement device. In an additional embodiment, the method may include scanning the specimen with an additional measurement device during polishing to generate additional output signals at additional measurement spots on the specimen. Such an embodiment may also include determining relative locations of the additional measurement spots on the specimen and correlating the output signals with the additional output signals having common locations. The measurement device and the additional measurement device may include an eddy current device and a reflectometer. In such an embodiment, the characteristic may be determined from output signals of the eddy current device and the reflectometer using a thin film model. For example, the characteristic may be a thickness of a metal film, which may be determined by indexing a thin film model from a measured reflectance of a metal film.

In an additional embodiment, the method may include assessing uniformity of the characteristic across the specimen from the two-dimensional map. For example, the method may include detecting one or more zones on the specimen having values of the characteristic outside of a predetermined range for the characteristic. In addition, such a method may include determining lateral dimensions of the one or more zones.

In a further embodiment, determining the characteristic may include applying a thin film model to the output signals generated at a first portion of the measurement spots. A film may be absent on the first portion of the measurement spots. In addition, the thin film model may be separately applied to output signals generated at a second portion of the measurement spots. The film may be present on the second portion of the measurement spots.

In an additional embodiment, the method may include detecting an endpoint of polishing from the two-dimensional map. The method may also include detecting an endpoint of polishing at the relative locations of one or more measurement spots from the two-dimensional map. In another embodiment, the two-dimensional map may be generated prior to an endpoint of polishing. In such an embodiment, the method may include estimating an endpoint of polishing from the two-dimensional map. The method may also include scanning the specimen with an additional measurement device during polishing to generate additional output signals at additional measurement spots on the specimen. Such a method may also include detecting the endpoint of polishing from the additional output signals. In a further embodiment, the method may include determining overpolishing of the specimen at the relative locations of one or more measurement spots from a detected endpoint and one or more parameters of polishing.

Another embodiment of the method may include performing the method during a first polish step of a polishing process. Such a method may also include providing the two-dimensional map to a processor configured to control a second polish step of the polishing process. Such an embodiment may also include altering an orientation of the specimen in a second polish step of the polishing process using the two-dimensional map. In an additional embodiment, the method may include correlating the two-dimensional map with an additional two-dimensional map of data generated by processing the specimen with an additional system.

A further embodiment of the method may include identifying variations in the characteristic across the specimen due to a localized variation in a parameter of the polishing process using the two-dimensional map. In another embodiment, the method may include altering a parameter of the polishing process in response to variations in the characteristic across the relative locations to reduce within specimen variation of the characteristic. In yet another embodiment, the method may include detecting a zone of the specimen having an average value of the characteristic outside of a predetermined range and altering a parameter of the polishing process within the zone.

An additional embodiment relates to a system configured to characterize a polishing process. The system may include a measurement device configured to scan a specimen during the polishing process to generate output signals at measurement spots on the specimen. The measurement device may include an eddy current device or a multi-angle reflectometer. The system may also include a processor coupled to the measurement device. The processor may be configured to determine a characteristic of the polishing process at the measurement spots from the output signals. The processor may also be configured to determine relative locations of the measurement spots on the specimen. In addition, the processor may be configured to generate a two-dimensional map of the characteristic at the relative locations of the measurement spots on the specimen. The measurement device and the processor may be further configured to perform any of the steps of the methods as described herein.

A further embodiment relates to a method for characterizing polishing of a specimen. Such an embodiment of a method may include scanning the specimen as described herein. The method may also include determining a characteristic of polishing at the measurement spots from output signals of a measurement device as described herein. In addition, the method may include determining absolute locations of the measurement spots on the specimen. In an embodiment, determining the absolute locations may include detecting a notch, a flat, or an identification mark of the specimen, and determining locations of the measurement spots on the specimen relative to a location of the detected notch, flat, or identification mark on the specimen. Determining the absolute locations may further include assigning coordinates to the measurement spots based on the relative locations of the measurement spots and coordinates of the detected notch, flat, or identification mark. The method may further include generating a two-dimensional map of the characteristic at the absolute locations of the measurement spots on the specimen.

In another embodiment, the method may include associating the characteristic at one of the absolute locations with a die arranged on the specimen at the one absolute location. A further embodiment of the method may include associating the characteristic at one of the absolute locations with test results of a semiconductor device formed on the specimen at the one absolute location. In an additional embodiment, the method may include determining over-polishing at one of the absolute locations and associating the over-polishing at the one absolute location with test results of a semiconductor device formed on the specimen at the one absolute location.

In a further embodiment, the method may include altering a parameter of polishing at one of the absolute locations in response to the characteristic at the one absolute location to reduce within specimen variation in the characteristic. In an additional embodiment, the method may include altering a parameter of polishing at one of the absolute locations in response to the characteristic at the one absolute location using an in situ control technique. The method may further include steps of other embodiments of methods as described herein.

An additional embodiment relates to a system configured to characterize a polishing process. The system may include a measurement device configured to scan a specimen during the polishing process to generate output signals at measurement spots on the specimen. The system may also include a processor coupled to the measurement device. The processor may be configured to determine a characteristic of the polishing process at the measurement spots from the output signals. The processor may also be configured to determine absolute locations of the measurement spots on the specimen. For example, in an embodiment, the system may be configured to detect a notch, flat, or identification mark of the specimen. In such an embodiment, the processor may be configured to determine locations of the measurement spots on the specimen relative to a location of the notch, flat, or identification mark on the specimen. The processor may also be configured to assign coordinates to the measurement spots based on the relative locations of the measurement spots and coordinates of the notch, flat, or identification mark to determine the absolute locations of the measurement spots on the specimen. In addition, the processor may be configured to generate a two-dimensional map of the characteristic at the absolute locations of the measurement spots on the specimen. The system may be further configured to perform steps of any of the embodiments of the methods as described herein.

A further embodiment relates to a computer-implemented method for determining a path of a measurement device configured to scan a specimen during a process such as polishing to generate output signals at measurement spots on the specimen. The method may include determining a representative scan path of the measurement device relative to the specimen. The representative scan path may include a relationship between two-dimensional coordinates of the measurement device during a scan and two-dimensional coordinates of a carrier configured to rotate the specimen during the process. The method may also include determining an average spacing between starting points of individual scans of the measurement device on the specimen. The starting points may be located proximate a perimeter of the specimen. In addition, the method may include determining a path of a sequence of the individual scans using the representative scan path and the average spacing between the starting points. The path may include a relationship between two-dimensional coordinates of the measurement device during a scan and two-dimensional coordinates of the specimen.

In an embodiment, the method may include associating output signals received from the measurement device with two-dimensional coordinates of the specimen using the path of the sequence. In an additional embodiment, the method may include determining an orientation of the path of the sequence of the individual scans with respect to a detected notch, flat, or identification mark of the specimen. Such an embodiment may also include assigning absolute coordinates to the measurement spots based on the orientation and the coordinates of the detected notch, flat, or identification mark. In an embodiment, the method may include determining a percentage of the specimen scanned by the measurement device during the sequence of the individual scans of the measurement device.

A two-dimensional spatially resolved map of characteristics such as metal thickness and optical reflectance values across a specimen provides several advantages over currently available methods of reporting polishing results by annular zones. For example, using such currently available methods, process engineers have no way of inspecting, verifying, and diagnosing wafers that polish in a non-uniform manner. Similarly, the choice of endpoint parameters is haphazard and at best heuristic without taking into account the wafer coverage information that the precession of sensor path determination provides. In addition, process engineers require deterministic methods for setting up, transferring, and modifying polish recipes. Currently available annular zone-based control schemes, however, do not provide such deterministic methods. Furthermore, the effect of de-ionized water provided to a self-clearing objective on the polish process may also be estimated from the precessed sensor path information. This effect may vary by wafer region and by relative rotational speeds of the polishing head and platen. The sensor path determinations provide information about this complicated relationship for the process engineer and aid in fine-tuning polish processes.

A two-dimensional map of a specimen generated as described herein may provide a two-dimensional computation of specimen surface non-uniformity. Currently available methods use either limited information from a single sensor sweep over the wafer or from merged results within annular specimen "zones." Such methods are inherently inaccurate because such methods rely on oversampled and averaged data values. Another advantage of the embodiments described herein is that the methods include generating a two-dimensional map of absolute locations of measurement spots on the specimen. For example, a specimen alignment device (or a pre-aligner) of a polishing tool may be configured to detect a notch, flat, or identification mark of a specimen. In this manner, an initial two-dimensional surface map may be generated and oriented to a position of the detected notch, flat, or identification mark. Furthermore, on polishing tools equipped with control mechanisms for altering local polish rates on a specimen, embodiments of methods described herein may provide accurate, two-dimensional non-uniformity parameters, unavailable in currently available methods, by which the polishing process may be controlled as it progresses.

An additional embodiment relates to a computer-implemented method for characterizing a process such as a polishing process. The method may include associating an output signal generated by an eddy current device with an output signal generated by a reflectometer. In an embodiment, the reflectometer may be a multi-angle reflectometer. A scan path of a sequence of individual scans of the eddy current device and the reflectometer over a specimen during the process may be determined as described herein. Therefore, output signals of the two devices generated at common measurement spots on the specimen may be associated. The method may also include determining a characteristic of the process at the measurement spot from the output signal of the eddy current device and the output signal of the reflectometer using a thin film model.

In an additional embodiment, the method may include generating a thin film model by varying a thickness of a material on the specimen at a polish rate of the material and determining a reflectance of the specimen at the varied thickness. In addition, the method may include generating the thin film model for a plurality of sensors of a reflectometer. In a further embodiment, the method may include fitting a regression line to a plurality of output signals of an eddy current device and estimating an endpoint of the process from the regression line. In such an embodiment, the method may include detecting an endpoint of the process from output signals of the reflectometer.

A further embodiment relates to a method for monitoring a parameter of a measurement device. The method may include scanning a specimen with the measurement device during polishing of the specimen to generate output signals at measurement spots on the specimen. The method may also include determining if the output signals are outside of a range of output signals. Output signals outside of the range may indicate that the parameter of the measurement device is outside of control limits for the parameter. The parameter may include a characteristic of light emitted by a light source of the measurement device or a characteristic of light detected by the measurement device. The parameter may also include a characteristic of light passed through a window disposed in a polishing pad and detected by the measurement device. In this manner, the characteristic may be responsive to scratches on the window. Output signals determined to be outside of the range may also indicate an electrical failure of the measurement device.

An additional embodiment relates to a method for monitoring a specimen during polishing. The method may include scanning the specimen with a measurement device such as an eddy current device or an optical device during polishing to generate output signals at measurement spots on the specimen. The method may also include determining if the output signals are outside of a range of output signals. Output signals outside of the range may indicate damage to the specimen. The damage may include, but is not limited to, damage to an uppermost layer formed on the specimen, breakage of an uppermost layer formed on the specimen, damage to multiple layers formed on the specimen, breakage of the specimen, and flexing of the specimen due to stress on the specimen caused by polishing.

An embodiment relates to a method for determining a characteristic of a polishing pad. The method may include scanning the polishing pad with a measurement device such as an eddy current device to generate output signals at measurement spots on the polishing pad. The method may also include determining the characteristic of the polishing pad from the output signals. The method may further include determining an approximate lifetime of the polishing pad from the characteristic. The characteristic may include a rate of wear of the polishing pad. In addition, the method may include altering a parameter of a polishing tool in response to the characteristic to reduce the rate of wear of the polishing pad. Furthermore, the method may include altering a parameter of pad conditioning in response to the characteristic.

A further embodiment relates to a method for characterizing polishing of a specimen. The method may include determining a thickness of a polishing pad. The polishing pad may be a fixed abrasive polishing pad. The method may also include altering a focus setting of a measurement device in response to the thickness of the polishing pad. Altering the focus setting may include altering a position of an optics assembly of the measurement device. Altering the focus setting may also be performed automatically by a system configured to perform the method. The measurement device may include a fiber optics assembly. In addition, the method may include scanning the specimen with the measurement device during polishing to generate output signals at measurement spots across the specimen. The method may further include determining a characteristic of polishing from the output signals.

Another embodiment relates to a method for determining a characteristic of a polishing tool. The method may include scanning a portion of the polishing tool with a measurement device such as an optical device to generate output signals at measurement spots on the portion of the polishing tool. The method may also include determining the characteristic of the polishing tool from the output signals. The portion of the polishing tool may include a carrier ring. In this manner, the characteristic may include a thickness of the carrier ring. In an embodiment, the polishing tool may also include multiple platens. In such an embodiment, the method may include determining a characteristic of at least two of the multiple platens from the output signals and determining variations in the characteristic of the at least two multiple platens.

Yet another embodiment relates to a method for characterizing polishing of a specimen. The method may include scanning the specimen with two or more measurement devices during polishing to generate output signals at measurement spots across the specimen. The measurement devices may include a reflectometer and a capacitance probe. The capacitance probe may include a conductive polymer probe. The method may also include determining a characteristic of polishing from the output signals. In addition, the method may include any steps of other embodiments of methods as described herein.

Another embodiment relates to a method for characterizing polishing of a specimen. The method may include scanning the specimen with two or more measurement devices during polishing to generate output signals at measurement spots across the specimen. The measurement devices may include an optical device and an eddy current device. In an embodiment, the optical device may include a spectrophotometer. In such an embodiment, one or more measurement spots on the specimen may include an area on the specimen including at least two proximate structures having different optical properties. The spectrophotometer may be configured to detect light reflected from the specimen at substantially zero-order. In an additional embodiment, the optical device may include a microscope based spectrophotometer coupled to a CCD camera. The method may also include determining a characteristic of polishing from the output signals. In addition, the method may include any steps of other embodiments of methods as described herein.

A further embodiment relates to a measurement device configured to scan a specimen during polishing of the specimen. The measurement device may include a light source configured to generate light. The light source may include a laser. The measurement device may also include a scanning assembly coupled to the light source. The scanning assembly may include a mechanical scanner. Alternatively, the scanning assembly may include an acousto-optical deflector. The scanning assembly may be configured to scan the light across the specimen during polishing to generate output signals at measurement spots across the specimen.

An additional embodiment relates to a method for characterizing polishing of a specimen. The method may include scanning the specimen with a measurement device during polishing to generate output signals at measurement spots across the specimen. The measurement device may include a laser light source coupled to a first fiber optic bundle and a detector coupled to a second fiber optic bundle. The measurement device may also include lenses coupled to the first fiber optic bundle. For example, the first fiber optic bundle may include a plurality of fiber optic elements, and lenses coupled to the fiber optic elements. A first portion of the first fiber optic bundle may be arranged at an angle to a second portion of the first fiber optic bundle (i.e., bent) such that the first fiber optic bundle may direct light from a laser light source to the specimen. The measurement device may also include lenses coupled to the second fiber optic bundle. For example, the second fiber optic bundle may include a plurality of fiber optic elements and lenses coupled to the fiber optic elements. A first portion of the second fiber optic bundle may be arranged at an angle to a second portion of the second fiber optic bundle (i.e., bent) such that the second fiber optic bundle may direct light from a specimen to a detector. The method may also include determining a characteristic of polishing from the output signals. In addition, the method may include any steps of other embodiments of methods as described herein.

Another embodiment relates to a method for characterizing polishing of a specimen. The method may include scanning the specimen with a first measurement device during a first step of the polishing process to generate output signals at measurement spots across the specimen. The method may also include generating a first portion of a signature from the output signals. The first portion of the signature may include a singularity representative of an endpoint of the first polish step. In an embodiment, the method may include altering a parameter of the first polish step in response to the singularity to substantially end the first polish step and to begin the second polish step. In an additional embodiment, the method may include automatically stopping generation of the first portion of the signature in response to the singularity. In addition, the method may include scanning the specimen with a second measurement device during a second step of the polishing process to generate additional output signals at the measurement spots. The method may further include generating a second portion of the signature from the additional output signals. The second portion of the signature may include a singularity representative of an endpoint of the second polish step. In addition, the method may include any steps of other embodiments of methods as described herein.

A further embodiment relates to a method for characterizing polishing of a specimen. The method may include scanning the specimen with an eddy current device during polishing to generate output signals at measurement spots on the specimen. The method may also include performing scanning with the measurement device until a predetermined thickness of a film is detected on the specimen from the output signals. In an embodiment, the predetermined thickness may be less than about 200 nm. In other embodiments, the predetermined thickness may be less than about 150 nm, or even less than about 80 nm. In addition, the method may include scanning the specimen with an optical device such as a reflectometer subsequent to detecting the predetermined thickness to generate additional output signals at the measurement spots on the specimen. In an additional embodiment, the method may include altering a parameter of polishing subsequent to detecting the predetermined thickness to reduce a speed of polishing during scanning the specimen with the optical device. In a further embodiment, the method may include determining an approximate endpoint of polishing from the additional output signals. The method may further include determining a characteristic of polishing from the output signals and the additional output signals. In addition, the method may include any steps of other embodiments of methods as described herein.

Each of the embodiments described herein may also include altering a parameter of the polishing process in response to a determined characteristic of the polishing such as, but not limited to, a determined presence of blobs on the specimen, a characteristic of the specimen within a zone on the specimen, a determined thickness of a film on the specimen, and a generated two-dimensional map of the specimen. The parameter of the polishing process may be altered using a feedback control technique, a feedforward control technique and/or an in situ control technique. In addition, each of the embodiments described herein may include fabricating a semiconductor device on the specimen.

BRIEF DESCRIPTION OF THE DRAWINGS

Further advantages of the present invention may become apparent to those skilled in the art with the benefit of the following detailed description of the preferred embodiments and upon reference to the accompanying drawings in which.

Figure 1:
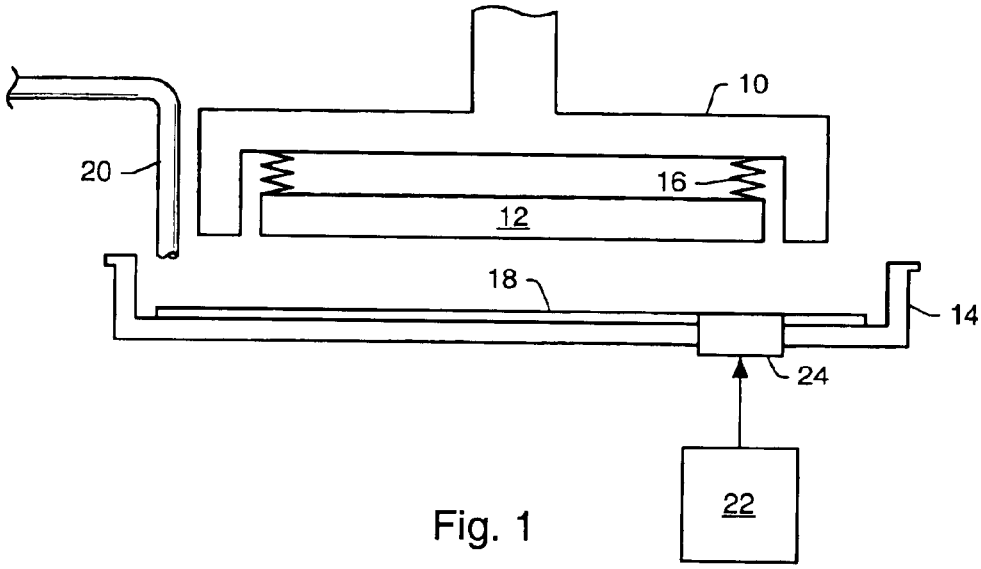
FIG. 1 depicts a schematic diagram of a side view of an embodiment of a polishing tool configured to polish a specimen.

While the invention is susceptible to various modifications and alternative forms, specific embodiments thereof are shown by way of example in the drawings and may herein be described in detail. The drawings may not be to scale. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION OF THE PREFERRED EMBODIMENTS

The following description generally relates to systems and methods for characterizing, monitoring, and/or controlling a polishing process. As used herein, a "specimen" is generally defined to include a wafer or a reticle. The term "wafer" generally refers to substrates formed of a semiconductor or a non-semiconductor material. Examples of such a semiconductor or a non-semiconductor material include, but are not limited to, monocrystalline silicon, gallium arsenide, and indium phosphide. Such substrates may be commonly found and/or processed in semiconductor fabrication facilities.

A wafer may include one or more layers that may be formed upon a semiconductor substrate. For example, such layers may include, but are not limited to, a resist, a dielectric material, and a conductive material. A resist may include a material that may be patterned by an optical lithography technique, an e-beam lithography technique, or an X-ray lithography technique. Examples of a dielectric material may include, but are not limited to, silicon dioxide, silicon nitride, silicon oxynitride, and titanium nitride. Additional examples of a dielectric material include "low-k" dielectric materials such as Black Diamond™ which is commercially available from Applied Materials, Inc., Santa Clara, Calif., CORAL™ commercially available from Novellus Systems, Inc., San Jose, Calif., "ultra-low k" dielectric materials such as "zero gels," and "high-k" dielectric materials such as tantalum pentoxide. In addition, examples of a conductive material may include, but are not limited to, aluminum, polysilicon, and copper.

One or more layers formed on a wafer may be patterned or unpatterned. For example, a wafer may include a plurality of dies having repeatable pattern features. Formation and processing of such layers of material may ultimately result in completed semiconductor devices. As such, a wafer may include a substrate on which not all layers of a complete semiconductor device have been formed or a substrate on which all layers of a complete semiconductor device have been formed.

As used herein, a "polishing process" may include chemical-mechanical polishing ("CMP") using a rotating polishing pad or linear polishing. Alternatively, a polishing process may include electropolishing. Chemical-mechanical polishing ("CMP") may typically be used in the semiconductor industry to reduce elevational disparities in, or to planarize, a layer on a specimen. Chemical-mechanical polishing may include holding and/or rotating a specimen against a rotating polishing platen under controlled pressure. FIG. 1 illustrates a schematic diagram of an embodiment of a polishing tool configured to polish a specimen. The polishing tool may include polishing head 10 configured to hold specimen 12 against polishing platen 14. Polishing head 10 may include a number of springs 16 or another suitable mechanical device, which may be configured to apply an adjustable pressure to a back side of specimen 12. Polishing head 10 may also be configured to rotate around a central axis of the polishing head. In addition, polishing head 10 may also be configured to move linearly with respect to the polishing platen.

Polishing platen 14 may include polishing pad 18. The polishing pad may have a sub pad (not shown), which may be configured such that polishing pad 18 may be securely coupled to polishing platen 14. Polishing pad 18 may also have a top pad (not shown), which may be configured to contact and polish specimen 12. The top pad of polishing pad 18 may include, for example, an open cell foamed polyurethane material or a polyurethane layer having a grooved surface. The top pad may also include additional abrasive materials or particles configured to partially remove material from specimen 12 or to polish specimen 12. Such a polishing pad may be commonly referred to as a "fixed abrasive" polishing pad. Appropriate polishing pads are commercially available from, for example, Thomas West, Inc., Sunnyvale, Calif., Rodel, Inc., Phoenix, Ariz., and Cabot Microelectronics, Aurora, Ill. Polishing platen 14 may also be configured to rotate around a central axis of the polishing platen. In addition, polishing head 10 may be configured to rotate around a central axis of the polishing head. A polishing tool may also include a single polishing platen or multiple polishing platens coupled to rotating polishing heads.

The polishing tool may also include dispense system 20. The dispense system may be configured to automatically dispense a polishing chemical such as a chemical polishing slurry onto polishing pad 18. A chemical polishing slurry may include abrasive particles and at least one chemical. For example, abrasive particles may include fused-silica particles, and a chemical may include potassium hydroxide. Alternatively, polishing pad 18 may be sufficiently abrasive such that the chemical polishing solution may be substantially free of particles. Suitable combinations of a polishing chemical and a polishing pad may vary depending on, for example, a composition and a topography of an upper layer on specimen 12 which is being partially removed or planarized and/or a composition and a topography of an underlying layer.

A system configured to characterize, monitor, and/or control a polishing process may include measurement device 22 coupled to the polishing tool. The measurement device may be configured according to any of the embodiments described herein. The measurement device may be coupled to the polishing tool such that the measurement device may be external to polishing platen 14. In this manner, the measurement device may be coupled to the polishing tool such that the measurement device may not interfere with the operation, performance, and/or control of the polishing process. For example, polishing platen 14 and polishing pad 18 may be retrofitted such that window 24 may be disposed in an opening of the polishing pad. Window 24 may be configured according to any of the embodiments described herein. The configuration of the chemical-mechanical polishing tool, however, may determine the placement and dimensions of window 24. Examples of windows disposed within polishing pads are illustrated in U.S. Pat. No. 6,171,181 to Roberts et al., U.S. Pat. No. 6,231,434 to Cook et al., and U.S. Pat. No. 6,254,459 to Bajaj et al., which are incorporated by reference as if fully set forth herein.

Window 24 may transmit an incident beam of light from a light source (not shown) of measurement device 22 outside the polishing platen to a surface of specimen 12 held in place by polishing head 10. Window 24 may also transmit light propagating from a surface of specimen 12 to a detector (not shown) of measurement device 22 external to the polishing platen. Window 24 may be formed of substantially optically transparent material. In addition, window 24 may be formed of a material that is substantially transparent to two or more wavelengths of light or broadband light. The teen "broadband light" is generally used to refer to radiation having a frequency-amplitude spectrum that includes two or more different frequency components. A broadband frequency-amplitude spectrum may include a broad range of wavelengths such as from approximately 190 nm to approximately 1700 nm. The range of wavelengths, however, may be larger or smaller depending on, for example, the light source capability, the sample being illuminated, and the property being determined. For example, a xenon arc lamp may be used as a broadband light source and may be configured to emit a light beam including visible and ultraviolet light. In this manner, window 24 may have optical or material properties such that light from a light source of measurement device 22 and light propagating from a surface of specimen 12 may pass through the window without undesirably altering the properties of the incident and returned light beams.

A gap between an optical objective of the measurement device and a pad window of the polishing pad may have a negative impact on the polishing process and the quality of the optical path thereby negatively impacting the optical signal quality. In an embodiment, an appropriate interface that may be disposed in this region may include a liquid, a gel, or a solid in various configurations. One method may use a viscous optical gel to fill the cavity between window surfaces. Alternatively, fluid such as water may be flowed or may be statically contained in the space. A transparent bladder or diaphragm as described herein may be used to enclose the fluid path. Furthermore, an air gap may be used with optically coated-surfaces. In addition, a soft filler material may be used to conform to spaces involved and maintain a good optical and mechanical path. One example may be a semi-solid insert that may fill the space between window surfaces. This insert may be of soft durometer and smaller in diameter than the pad perforation such that it may expand to fill the available space and maintain a sufficient optical and mechanical interface.

Figure 1A:
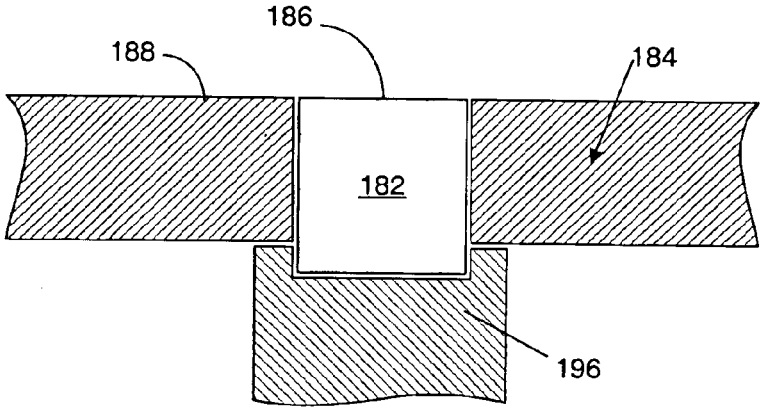
FIGS. 1*a*–1*m* depict schematic side views of various embodiments of a window configurable to be coupled to a process tool such as a polishing tool.

FIG. 1*a* illustrates an embodiment of window 182 configurable to be coupled to a process tool such as a polishing tool. The window may be formed of a substantially transparent gel. For example, substantially the entire window may be formed of the substantially transparent gel. In an embodiment, the gel may be substantially transparent to more than one wavelength of light. In this manner, the window may be coupled to a measurement device that includes a spectroscopic light source such as a spectroscopic reflectometer. The gel may be an elastomer. For example, the gel may include a triblock copolymer having a general configuration of poly(styrene-ethylene-butylene-styrene) and a plasticizing oil. Examples of an appropriate triblock copolymer are illustrated in U.S. Pat. No. 4,369,284 to Chen and U.S. Pat. No. 4,618,213 to Chen, which are incorporated by reference as if fully set forth herein.

An appropriate triblock copolymer may have the more general configuration A-B-A. A is a crystalline polymer end block segment of, for example, polystyrene, and B is a elastomeric polymer center block segment of, for example, poly(ethylene-butylene). The poly(ethylene-butylene) and polystyrene portions are incompatible and form a two-phase system consisting of sub-micron domains of glassy polystyrene interconnected by flexible poly(ethylene-butylene) chains. These domains serve to crosslink and reinforce the structure. This physical elastomeric network structure is reversible, and although heating the polymer above the softening point of polystyrene temporarily disrupts the structure, it can be restored by lowering the temperature.

Plasticizers are known in the art and include rubber processing oils such as paraffinic and naphthenic petroleum oils, highly refined aromatic-free paraffinic and naphthenic food and technical grade white petroleum mineral oils, and synthetic liquid oligomers of polybutene, polypropene, and polyterpene. The synthetic series process oils are high molecular weight oligomers, which are permanently fluid liquid monoolefins, isoparaffins or paraffins of moderate to high viscosity. Many such oils are known and commercially available.

The triblock copolymer component by itself lacks the desirable properties. However, when the triblock copolymer is combined with selected plasticizing oils with an average molecular weight of between about 200 to about 700, as determined by ebulliscopic methods, wherein, for most purposes, the oil constitutes about 300 to about 1,600 parts and more preferably about 350 to about 1,600 parts by weight of the triblock copolymer, an extremely soft and highly elastic material is obtained. This transformation of the triblock copolymer structure in heated oil results in a composition having a gel rigidity of about 20 gram to about 700 gram Bloom without substantial oil bleedout, high tensile strength and elongation, and other desirable combinations of physical properties. As used herein, the term "gel rigidity" in gram Bloom is determined by the gram weight required to depress a gel a distance of 4 mm with a piston having a cross-sectional area of 1 square centimeter at 23° C.

Therefore, a poly(styrene-ethylene-butylene-styrene) triblock copolymer having styrene end block to ethylene and butylene center block ratio of from between 31:69 to 40:60 when blended in the melt with an appropriate amount of plasticizing oil makes possible the attainment of gelatinous elastomer compositions having a desirable combination of physical and mechanical properties, notably high elongation at break of at least 1,600%, ultimate tensile strength exceeding $8\times10^5$ dyne/cm$^2$, low elongation set at break of substantially not greater than about 2%, tear resistance of at least $5\times10^5$ dyne/cm$^2$, substantially about 100% snap back when extended to 1,200% elongation, and a gel rigidity of substantially not greater than about 700 gram Bloom.

As shown in FIG. 1*a,* window 182 may be disposed in an opening formed in polishing pad 184. In addition, window 182 may be bonded to polishing pad 184. For example, window 182 may be coupled to polishing pad 184 by ultrasonic welding. The opening may be formed through substantially an entire thickness of the polishing pad. In this manner, a thickness of window 182 may be approximately equal to or greater than a thickness of polishing pad 184. Upper surface 186 of window 182 may be substantially coplanar with polishing surface 188 of polishing pad 184. In addition, a volume of the window may be approximately equal to or greater than a volume of the opening. Alternatively, a cross-sectional area of window 182, in a direction substantially parallel to upper surface 186, may be less than a cross-sectional area of the opening in that direction. As such, window 182 may expand along this direction. For example, the window may be formed of a gel that may compress in response to a pressure on an upper surface of the window. When the gel compresses, it may expand in a direction substantially parallel to upper surface 186. In addition, the gel may compress in response to a reduction in thickness of the polishing pad. In this manner, the gel may be configured to compress such that an upper surface of the window is substantially coplanar with a polishing surface of the polishing pad despite a reduction in thickness of the polishing pad. Furthermore, the gel may be configured to compress during polishing of a specimen on the polishing pad such that a rate of wear of the gel during polishing is approximately zero, or negligible.

Figure 1B:
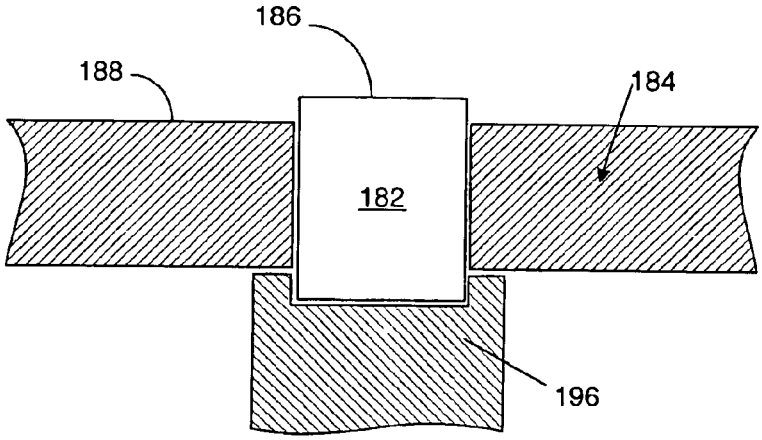

In an alternative embodiment, upper surface 186 of window 182 may not be coplanar with polishing surface 188 of polishing pad 184. For example, upper surface 186 of window 182 may be higher than polishing surface 188 of polishing pad 184, as shown in FIG. 1*b.* In such an embodiment, the gel may compress such that an upper surface of the window may be substantially coplanar with the polishing surface of the polishing pad during polishing. In addition, the gel may be configured to compress during polishing of a specimen on the polishing pad such that a rate of wear of the gel during polishing is negligible.

Figure 1C:
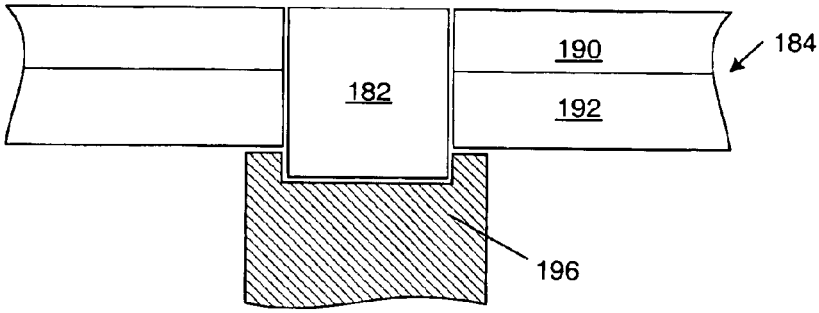

In an embodiment, as shown in FIG. 1*c,* polishing pad 184 may include top pad 190 and sub pad 192. The opening in the polishing pad may be formed through the top pad and the sub pad. The top pad may be configured to contact a specimen during polishing. The sub pad may be configured to provide mechanical support to the top pad.

Figure 1D:
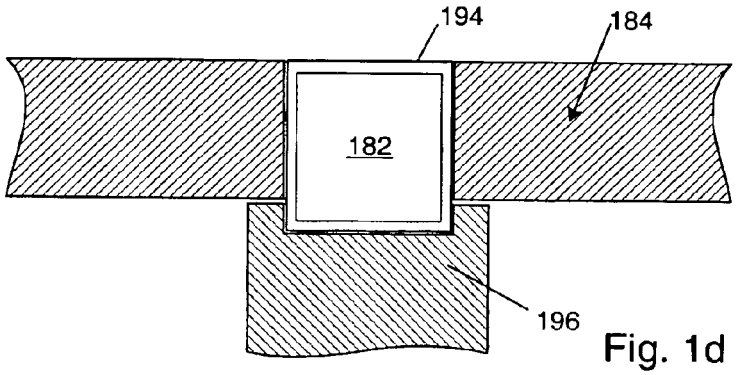
Figure 1E:
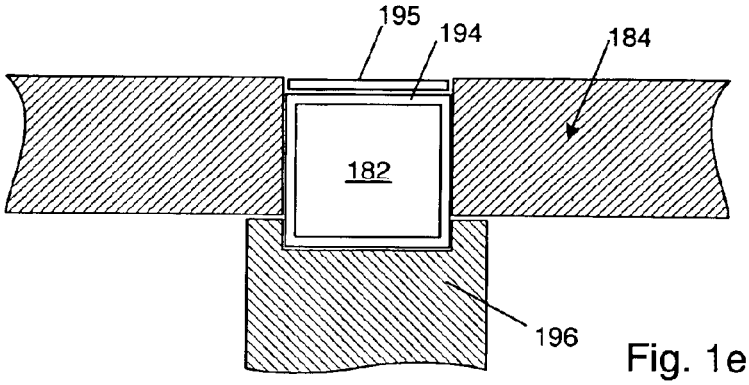

In another embodiment, shown in FIG. 1*d,* membrane 194 may be configured to surround window 182. The membrane may be formed of a polyurethane. The membrane may also be formed of any substantially transparent material. The membrane may be bonded to the polishing pad as described above. Top window 195 may optionally be coupled to an upper surface of membrane 194, as shown in FIG. 1*e.* The top window may be bonded to membrane 194, and may be formed of a material such as polyurethane.

Figure 1F:
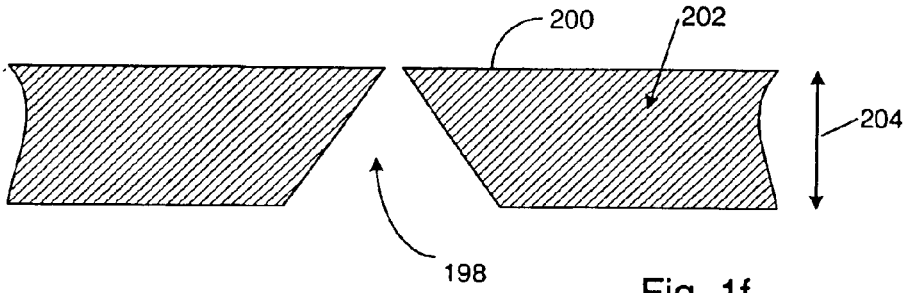

A cross-sectional area of the opening in a direction substantially parallel to a polishing surface of the polishing pad may be substantially constant along a thickness of the polishing pad, as shown in FIGS. 1*a*–1*e.* In an alternative embodiment, a cross-sectional area of the opening in a direction substantially parallel to a polishing surface of the polishing pad may not be constant along a thickness of the polishing pad. For example, as shown in FIG. 1*f,* a cross-sectional area of opening 198 in a direction substantially parallel to polishing surface 200 of polishing pad 202 may vary linearly along thickness 204 of the polishing pad. In other embodiments, the cross-sectional area of the opening in the polishing pad, in a direction substantially parallel to the polishing surface of the polishing pad, may vary non-linearly along a thickness of the polishing pad. The gel described herein may accommodate such thickness variations of the opening in the polishing pad. As such, a window that is formed of such a gel may be disposed within an opening in a polishing pad that has a variable cross-sectional area along a thickness of the polishing pad.

In an embodiment, as shown in FIGS. 1*a*–1*e,* a system may include measurement device 196 coupled to window 182. Window 182 may be bonded to an optical element (not shown) such as fixed optics of the measurement device including, for example, an objective housing, an objective, and a filler disposed between the objective and the replaceable window. Alternatively, if a membrane surrounds the gel as described herein, the membrane may be bonded to the optical element of the measurement device. The measurement device may be configured to generate output signals responsive to a characteristic of a specimen disposed within a process tool such as during polishing of a specimen in a polishing tool. Such a system may be incorporated into a polishing tool configured to polish a specimen as described herein.

Figure 1G:
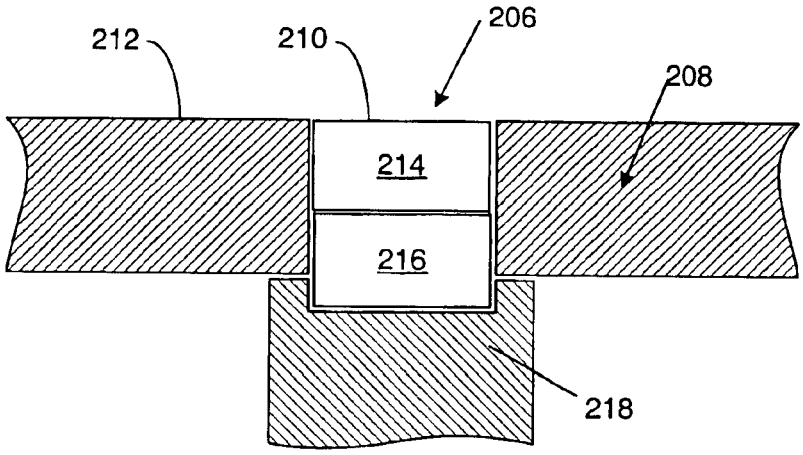

FIG. 1*g* illustrates an additional embodiment of window 206 configured to be coupled to a process tool. For example, the window may be disposed within an opening in polishing pad 208. The polishing pad may be configured to contact a specimen during polishing. The window may be bonded to the polishing pad. For example, the window may be coupled to the polishing pad by ultrasonic welding. Upper surface 210 of window 206 may be located proximate to polishing surface 212 of polishing pad 208. Upper surface 210 may be substantially coplanar with polishing surface 212 of the polishing pad. The window may include first portion 214 disposed proximate upper surface 210 of window 206. The first portion of the window may be formed of a first material. The window may also include second portion 216. The first portion may be coupled to the second portion. For example, the first portion may be bonded to the second portion. Second portion 216 may be coupled to first portion 214 such that second portion 216 may be spaced from upper surface 210 of window 206 by first portion 214. The second portion may be formed of a material different than the first material.

In an embodiment, the first material may be substantially transparent. In addition, the second material may be substantially transparent. For example, the first and second materials may be substantially transparent to at least one wavelength of light emitted by a light source of the measurement device. Furthermore, the first and second materials may be substantially transparent to more than one wavelength of light. In this manner, the window may be coupled to a measurement device that includes a spectroscopic light source such as a spectroscopic reflectometer. In an embodiment, the first material may be formed of, but is not limited to, polyurethane. In contrast, the second material may be a gel. The second material may include a triblock copolymer as described herein. In addition, the second material may be a gelatinous elastomer. In this manner, the second material may compress in response to a pressure applied to upper surface 210 of window 206. In addition, the second material may compress in response to a reduction in a thickness of polishing pad 208. As such, the second material may compress such that the upper surface of the window may be substantially coplanar with the polishing surface of the polishing pad. In one embodiment, the second portion may be configured to compress during conditioning of the polishing pad such that the conditioning across the window may be substantially uniform.

Figure 1H:
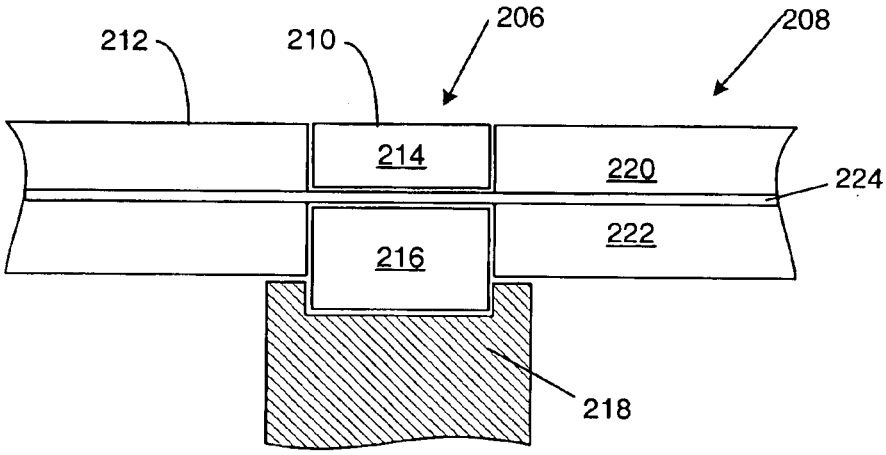

As shown in FIG. 1*h,* polishing pad 208 may include top pad 220 and sub pad 222. A thickness of first portion 214 of window 206 may be approximately equal to or greater than a thickness of the top pad. In addition, a thickness of second portion 216 of window 206 may be approximately equal to or greater than a thickness of the sub pad. Polishing pad 208 may also include adhesive film 224 disposed between the top pad and the sub pad. The adhesive film may also be disposed between the first portion-of the window and the second portion of the window.

Figure 1I:
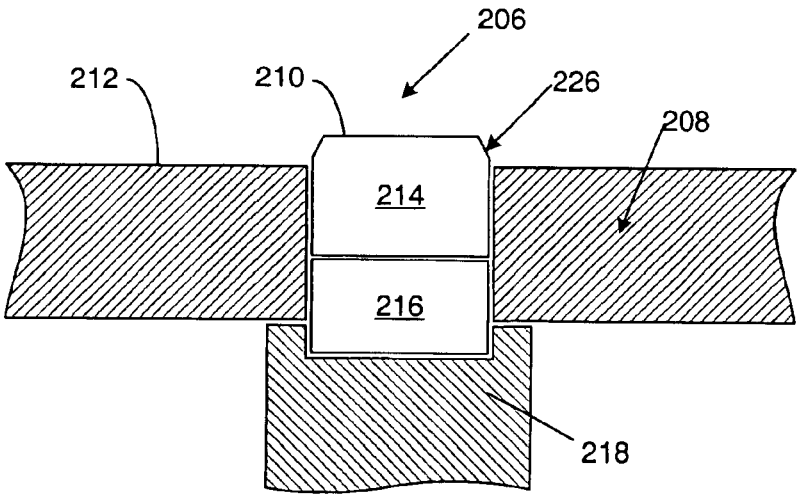
Figure 1J:
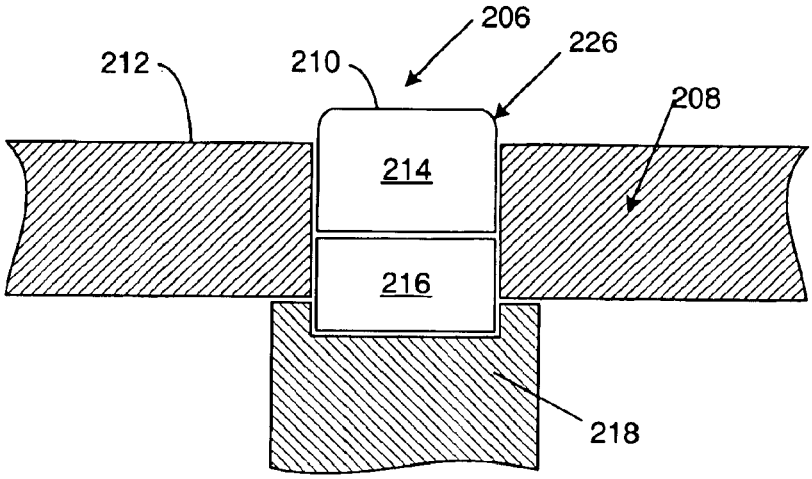

As shown in FIG. 1*i,* upper surface 210 of window 206 may not be coplanar with polishing surface 212 of the polishing pad. In such an embodiment, the second material may be configured to compress during conditioning of the polishing pad such that conditioning across the window may be substantially uniform. For example, the second portion may provide support to the first portion of the window to maintain a height of the window and pressure on the window during conditioning to achieve substantially uniform conditioning across the window. Alternatively, conditioning of the pad may reduce a thickness of the first portion such that the upper surface of the window may be substantially coplanar with the polishing surface subsequent to conditioning. Reducing the thickness of the window during conditioning may also provide a planar surface on the window with substantially uniform scratching. As shown in FIG. 1*i,* outer edge 226 of the upper surface of window 206 may be beveled. Alternatively, as shown in FIG. 1*j,* outer edge 226 of the upper surface of window 206 may be rounded. Such beveled or rounded outer edges may reduce damage to a specimen or specimen loss during polishing.

A cross-sectional area of the opening in a direction substantially parallel to a polishing surface of the polishing pad may be substantially constant along a thickness of the polishing pad, as shown in FIGS. 1*g*–1*j*. In an alternative embodiment, a cross-sectional area of the opening in a direction substantially parallel to a polishing surface of the polishing pad may be not be constant along a thickness of the polishing pad as described above. For example, a cross-sectional area of the opening in a direction substantially parallel to the polishing surface of the polishing pad may vary linearly or non-linearly along a thickness of the polishing pad. The gel, and therefore a window formed of such a gel, as described herein may accommodate such thickness variations of the opening in the polishing pad.

In an embodiment, as shown in FIGS. 1*g*–1*j,* a system may include measurement device 218 coupled to window 206. For example, window 206 may be bonded to an optical element (not shown) such as fixed optics of the measurement device such as an objective housing, an objective, and a filler disposed between the objective and the replaceable window. Measurement device 218 may be configured to generate output signals responsive to a characteristic of a specimen disposed within a process tool such as a polishing tool. Measurement device 218 may be further configured as described herein. Such a system may be incorporated into a polishing tool configured to polish a specimen as described herein.

Figure 1K:
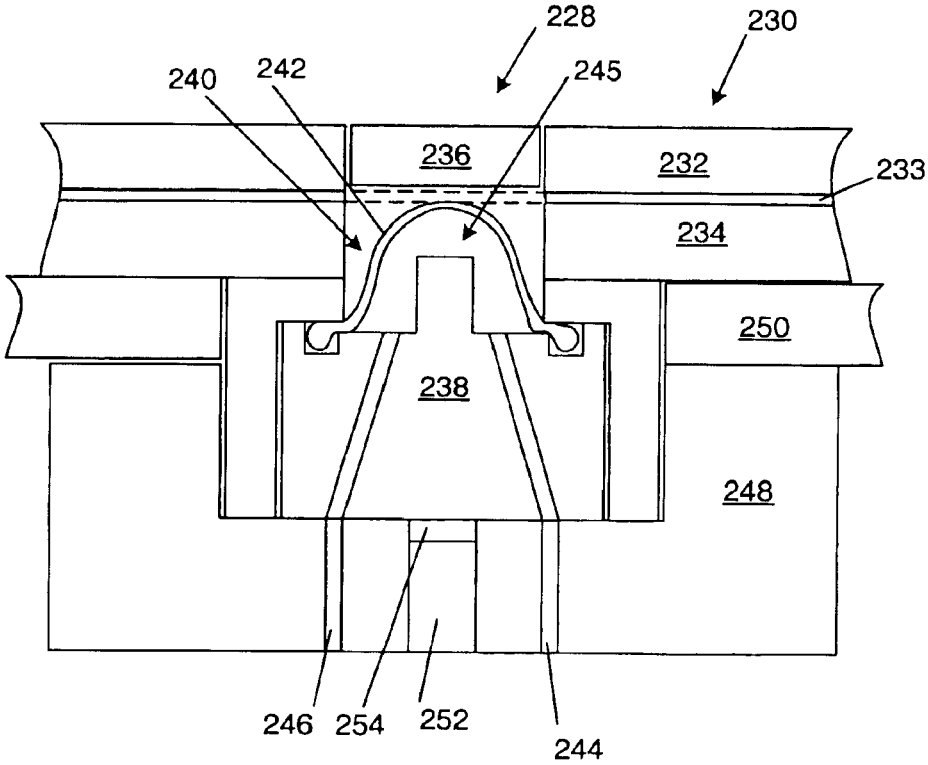

FIG. 1*k* illustrates an additional embodiment of window 228 configurable to be coupled to a process tool such as a polishing tool. For example, window 228 may be disposed within an opening in a polishing pad 230. Polishing pad 230 may include top pad 232, adhesive film 233, and sub pad 234, which may be configured as described herein. In one embodiment, the opening may be formed through the top pad, the adhesive film, and the sub pad. Window 228 may include upper window 236. The upper surface of the upper window may be proximate to a polishing surface of the polishing pad. In another embodiment, the adhesive film may extend through the opening in the polishing pad proximate the lower surface of upper window 236 as shown in phantom in FIG. 1*k*. Upper window 236 may be formed of, but is not limited to, polyurethane or a gel described herein. A thickness of the upper window may be approximately equal to or greater than a thickness of a top pad of the polishing pad. The upper window may be coupled to the polishing pad by ultrasonic welding. Window 228 may also include housing 238 coupled to upper window 236. The housing may be configured such that gap 240 is disposed in the opening between upper surfaces of housing 238 and a lower surface of upper window 228.

In addition, the window may include diaphragm 242 coupled to housing 238. The diaphragm may be disposed in the gap. The housing may be configured to allow a fluid to flow through inlet 244 into space 245 between the surfaces of the housing and the diaphragm. In addition, the housing may be configured to allow a fluid to flow though outlet 246 out of a space between the surfaces of the housing and the diaphragm. In one embodiment, the fluid may include water. In this embodiment, the diaphragm may be substantially impermeable to water. In other embodiments, the fluid may include water and other fluids or a fluid other than water. Appropriate fluids may also include any fluid that is substantially transparent to one or more wavelengths of light emitted by a light source coupled to the window. The light source may be incorporated in a measurement device coupled to the window. The diaphragm may be configured to expand such that a volume of the space may be approximately equal to a volume of the gap. In an embodiment, the upper window, the housing, and the diaphragm may be formed of materials that are substantially transparent to at least one wavelength of light. For example, the upper window, the housing, and the diaphragm may be substantially transparent to at least one wavelength of light emitted by a light source of a measurement device coupled to the window. In addition, the upper window, the housing, and the diaphragm may be formed of materials that are substantially transparent to more than one wavelength of light.

In an embodiment, as shown in FIG. 1*k,* a system may include objective housing 248 of a measurement device coupled to housing 238 below platen 250. The measurement device may be configured to generate output signals responsive to a characteristic of a specimen disposed in a process tool such as during polishing. Objective housing 248 may include objective 252 and filler 254 disposed between objective 252 and housing 238. The filler may include a material having elastic properties such that the material may reduce, and may even prevent, damage caused by contact between the objective and the housing. For example, the filler may include a gel as described herein. Housing 238 may be bonded to the objective housing of the measurement device. Such a system may be incorporated into a polishing tool configured to polish a specimen as described herein.

Figure 1L:
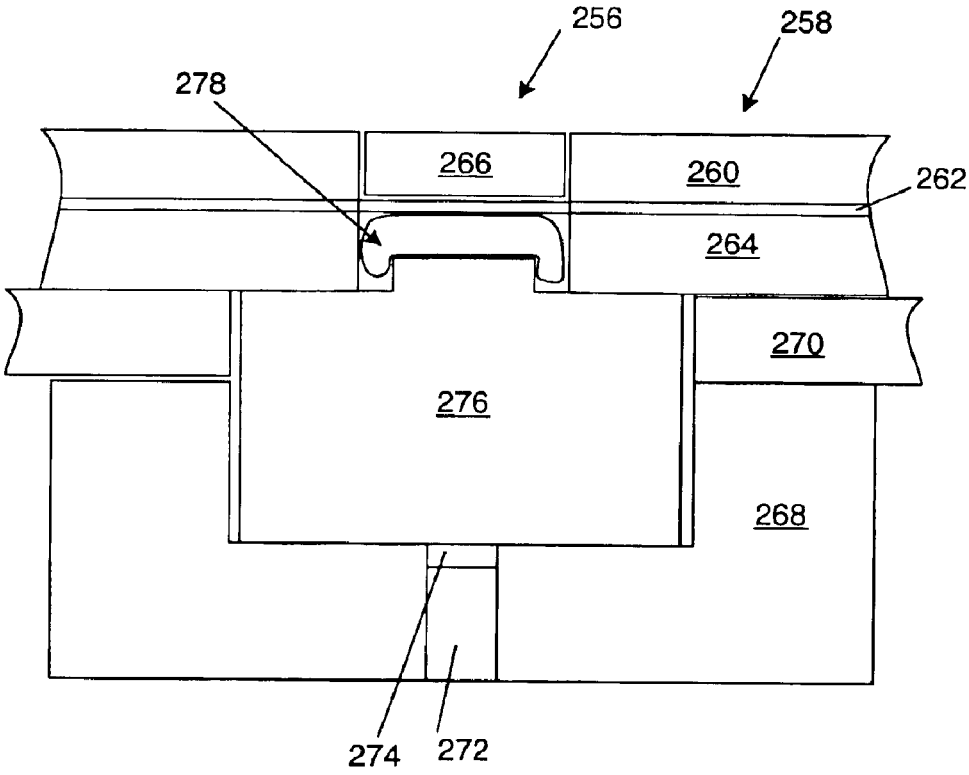

FIG. 1*l* illustrates an embodiment of window 256 configurable to be coupled to a process tool such as a polishing tool: For example, window 256 may be disposed within an opening in polishing pad 258. Polishing pad 258 may include top pad 260, adhesive film 262, and sub pad 264, which may be configured as described herein. In one embodiment, the opening may be formed through the top pad, the adhesive film, and the sub pad. Alternatively, the adhesive film may extend through the opening in the polishing pad proximate the lower surface of upper window 266. Upper window 266 may be formed of, but is not limited to, polyurethane or a gel described herein. A thickness of the upper window may be approximately equal to or greater than a thickness of a top pad of the polishing pad. The upper window may be coupled to the polishing pad by ultrasonic welding.

In an embodiment, as shown in FIG. 1*l*, a system may include objective housing 268 of a measurement device coupled to platen 270. Objective housing 268 may include objective 272 and filler 274 disposed between objective 272 and replaceable window 276. The filler may include a material having elastic properties such that the material may reduce, and may even prevent, damage caused by contact between the objective and the replaceable window. Soft filler material 278 may be disposed between the replaceable window and the adhesive film. Filler material 278 may be used to conform to the spaces involved and to maintain a good optical and mechanical path. One example of an appropriate filler material may be a semi-solid insert that may fill the space between window surfaces. This insert may be of soft durometer and smaller in diameter than the pad perforation such that it may expand to fill the available space and maintain a good optical and mechanical interface. The filler material may also be formed of a substantially transparent material, which may be transparent at one or more wavelengths. In one example, the filler material may be formed of a gel described herein. Such a system may be incorporated into a polishing tool configured to polish a specimen as described herein.

Figure 1M:
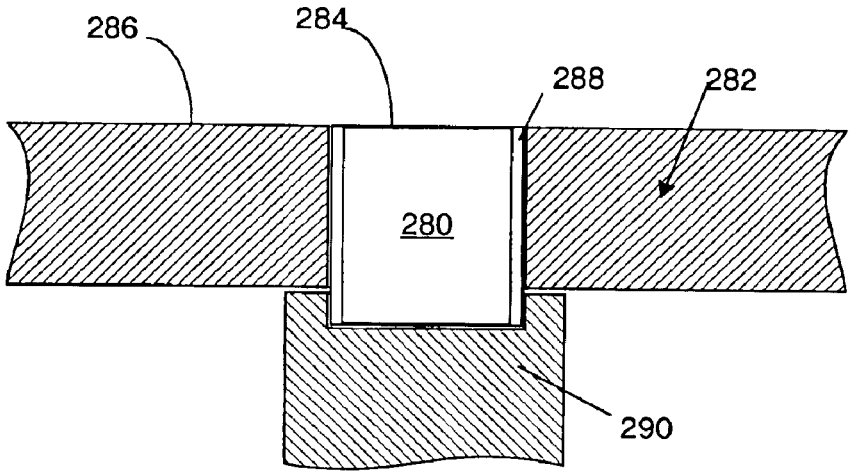

FIG. 1*m* illustrates an embodiment of window 280 configurable to be disposed within or coupled to a process tool such as a polishing tool. Window 280 may be disposed in an opening formed in polishing pad 282. The opening may be formed through substantially an entire thickness of the polishing pad. In this manner, a thickness of window 280 may be approximately equal to or greater than a thickness of polishing pad 282. Upper surface 284 of window 280 may be proximate to a polishing surface of the polishing pad. In addition, upper surface 284 of window 280 may be substantially coplanar with polishing surface 286 of polishing pad 282. A cross-sectional area of window 280, in a direction substantially parallel to upper surface 284, may be less than a cross-sectional area of the opening in that direction. Layer of material 288 may be formed between lateral surfaces of the window and lateral surfaces of the opening in the polishing pad. In addition, layer of material 288 may be coupled to, or bonded to, lateral surfaces of window 280. For example, layer of material 288 may be coupled to the window by ultrasonic welding. In addition, layer of material 288 may be bonded to polishing pad 282. Layer of material 288 may also be coupled to polishing pad 282 by ultrasonic welding.

The window and the layer of material may be formed of substantially transparent materials. For example, the window and the layer of material may be substantially transparent to at least one wavelength of light emitted by a light source of a measurement device coupled to the window. In addition, the window and the layer of material may be substantially transparent to more than one wavelength of light. A thickness of the layer of material may be substantially less than a thickness of the window. For example, a thickness of the layer may be less than about 15 mm. In an embodiment, the layer of material may be formed of a triblock copolymer and a plasticizing oil as described herein. The layer of material may include an elastomer. Movement of the window may compress the layer of material. In addition, the layer of material may be configured to compress in response to a pressure applied to an upper surface of the window.

As shown in FIG. 1*m*, a system may include measurement device 290 coupled to window 280. For example, window 280 may be bonded to an optical element (not shown) of the measurement device such as fixed optics including, but not limited to, an objective housing, an objective, and a filler disposed between the objective and the replaceable window. The measurement device may be configured to generate output signals responsive to a characteristic of a specimen disposed within a process tool such as during polishing. Such a system may be incorporated into a polishing tool configured to polish a specimen as described herein.

An additional embodiment relates to a measurement device configurable to be coupled to a polishing pad. The measurement device may include a light source as described herein. In this embodiment, the light source is configurable to direct light through a portion of the polishing pad. A wavelength, and optionally other characteristics, of the directed light may be selected in response to a characteristic of the polishing pad. For example, some polishing pads may transmit a substantial portion of light in one wavelength regime such as infrared light but may reflect a substantial portion of light in another wavelength regime such as visible and ultraviolet light. Therefore, the wavelength of the directed light may be selected to include infrared light in some embodiments. An appropriate wavelength of light may be determined, in some embodiments, by measuring absorbance and transmittance of a polishing pad over a range of wavelengths. Wavelengths of light that are transmitted by the polishing pad above a predetermined transmittance value may be designated as available for selection as the directed light. The predetermined transmittance value may vary depending upon, for example, the amount of light that would be returned from the specimen and through the polishing pad, the amount of light that could be collected by the measurement device, the amount of light that the measurement device would have to collect to produce output signals, and the signal-to-noise ratio of the measurement device.

In addition, the measurement device may include a collector as described herein. In this embodiment, the collector is configurable to collect light returned through the polishing pad. In this manner, a measurement device may be configured to scan measurement spots on a specimen through a polishing pad during polishing. Such embodiments may advantageously provide information acquisition or scanning capability through polishing pads or portions of polishing pads that do not include a window. In addition, because a specimen can be scanned through a polishing pad, a self-clearing objective would not be required to remove slurry, other polishing chemicals, and/or polished material from the objective. Eliminating a window and/or a self-clearing objective in a polishing pad may reduce the possibility for such elements to cause localized variations in the polishing process. Therefore, scanning a specimen through a polishing pad may increase the uniformity of one or more characteristics of a polishing process across a specimen and/or may increase the uniformity of one or more characteristics of a polished specimen.

In another embodiment, the polishing pad may include a top pad and a sub pad. The top pad may be configured to contact a specimen during polishing. An opening may be formed through the sub pad. In such an embodiment, the measurement device may be configured to direct light through a portion of the top pad above the opening. In this embodiment, a wavelength of the directed light may be selected in response to a characteristic of the portion of the top pad. The wavelength may be selected as described above. In addition, the measurement device may be configured to collect light returned through the portion of the top pad during polishing. Such embodiments may provide the advantages described above such as increased uniformity of characteristics of a polishing process and/or increased uniformity of characteristics of a polished specimen because an opening is not formed in the top pad. In addition, since light is not directed through the sub pad in these embodiments, a larger number of wavelengths may be available for scanning a specimen during polishing.

A further embodiment relates to another measurement device configurable to be coupled to a polishing pad. The measurement device may include a light source as described herein. In this embodiment, the light source is configurable to direct two beams of light through a portion of the polishing pad. One of the two beams of light may include a reference beam of light that is responsive to a characteristic of the polishing pad. For example, the wavelength, and/or other characteristics, of the reference beam of light may be selected such that a change in the characteristic of the polishing pad will cause a detectable, and preferably predictable and repeatable, change in the reference beam of light. In this manner, the reference beam of light may be used to monitor the characteristic of the polishing pad over time or during a polishing process. In one example, the reference beam of light may be used to monitor a thickness of a fixed abrasive polishing pad over time or during a polishing process. The other beam of light may be used to scan a specimen through the portion of the polishing pad during a polishing process. As described above, a wavelength, and/or other characteristics, of this beam of light may be selected in response to a characteristic of the polishing pad such that an appropriate amount of light is scanned over the specimen and such that an appropriate amount of light can be returned from the specimen, through the polishing pad, and to a collector of the measurement device.

The collector may be configured as described herein, and in these embodiments, is configurable to collect the two beams of light returned through the portion of the polishing pad. The collector may be configured to separately collect the two beams of light or to collect the two beams of light together. For example, it is envisioned that the two beams of light selected for these embodiments may have different characteristics such as wavelength. Therefore, the two beams of light could be collected together or separately, and in either case, detected separately. The returned reference beam of light is responsive to a characteristic of the polishing pad. Therefore, an output signal responsive to the returned reference beam of light may be used to determine and monitor a characteristic of the polishing pad over time or during a polishing process. The characteristic of the polishing pad may be used to alter a parameter of polishing and/or a parameter of the measurement device. For example, the characteristic may be a thickness of the polishing pad, which may be used to alter a focus setting of the measurement device as described herein. In addition, an output signal responsive to the other returned beam of light may be used to determine a characteristic of polishing and/or a characteristic of the specimen being polished. This characteristic may also be used to alter a parameter of polishing and/or a parameter of the measurement device as described herein.

Such embodiments may provide the advantages described above. In addition, because such embodiments can be used to monitor characteristics of the polishing pad over time or during a polishing process, the embodiments may increase the amount of data about polishing that may be acquired. The increased amount of data may aid in understanding and analyzing the polishing process and may also provide tighter and more accurate control of the polishing process. For example, such embodiments also provide the capability to alter parameters of polishing or the measurement device in real time in response to the monitored characteristic of the polishing pad. In addition, because the data may be used to alter parameters such as the focus setting of a measurement device coupled to the polishing pad, such embodiments may also provide more accurate measurements of a characteristic of polishing and/or a characteristic of a specimen being polished.

In an embodiment, the polishing pad may include a top pad and a sub pad that may be configured as described herein. In such an embodiment, the measurement device may be configured to direct the two beams of light through a portion of the top pad above an opening in the sub pad during polishing. In addition, the measurement device may be configured to collect the two beams of light returned from the specimen through the portion of the top pad during polishing. In this embodiment, one of the two beams of light is a reference beam of light, and the returned reference beam of light is responsive to a characteristic of the portion of the top pad. The characteristics of the two beams of light may be selected as described above. This embodiment may be further configured as described above. Such embodiments may provide the advantages described above such as increased uniformity of characteristics of a polishing process and/or increased uniformity of characteristics of a polished specimen because an opening is not formed in the top pad. In addition, since light is not directed through the sub pad in these embodiments, a larger number of wavelengths may be available for monitoring the characteristic of the polishing pad and for scanning a specimen during polishing.

Polishing chemicals such as chemical-polishing slurries may include abrasive particles and chemicals, which may interfere with or alter light from the light source and light propagating from a surface of the specimen. In addition, material removed from the specimen may interfere with or alter light from the light source and light propagating from a surface of the specimen. In an embodiment, therefore, window 24, as shown in FIG. 1, may be configured to function as a self-clearing objective. The self-clearing objective may include an optical component configured to transmit light from a light source toward a surface of specimen 12. A self-clearing objective may also be configured to flow a substantially transparent fluid between the self-clearing objective and the specimen. The flowing fluid may be configured to remove abrasive particles, chemicals, and material removed from the specimen such that light may be transmitted from the measurement device to the specimen and from the specimen to a collector and/or a detector of the measurement device without undesirable alterations in the optical properties of the light. Examples of self-clearing objectives are illustrated in U.S. patent application Ser. Nos. 09/396,143, "Apparatus and Methods for Performing Self-Clearing Optical Measurements," to Nikoonahad et al., and 09/556,238, "Apparatus and Methods for Detecting Killer Particles During Chemical Mechanical Polishing," to Nikoonahad et al., which are incorporated by reference as if fully set forth herein.

Examples of polishing tools and methods are illustrated in U.S. Pat. No. 5,730,642 to Sandhu et al., U.S. Pat. No. 5,872,633 to Holzapfel et al., U.S. Pat. No. 5,964,643 to Birang et al., U.S. Pat. No. 6,012,966 to Ban et al., U.S. Pat. No. 6,045,433 to Dvir et al., U.S. Pat. No. 6,159,073 to Wiswesser et al., and U.S. Pat. No. 6,179,709 to Redeker et al., and are incorporated by reference as if fully set forth herein. Additional examples of polishing tools and methods are illustrated in PCT Application Nos. WO 99/23449 to Wiswesser, WO 00/00873 to Campbell et al., WO 00/00874 to Campbell et al., WO 00/18543 to Fishkin et al., WO 00/26609 to Wiswesser et al., and WO 00/26613 to Wiswesser et al., and European Patent Application Nos. EP 1 022 093 A2 to Schoenleber et al., and EP 1 066 925 A2 to Zuniga et al., and are incorporated by reference as if fully set forth herein. An additional example of an integrated manufacturing tool including electroplating, chemical-mechanical polishing, clean and dry stations is illustrated PCT Application No. WO 99/25004 to Sasson et al., and is incorporated by reference as if fully set forth herein. An example of electropolishing is illustrated in U.S. Pat. No. 6,328,872 to Talieh et al., which is incorporated by reference as if fully set forth herein.

Figure 2:
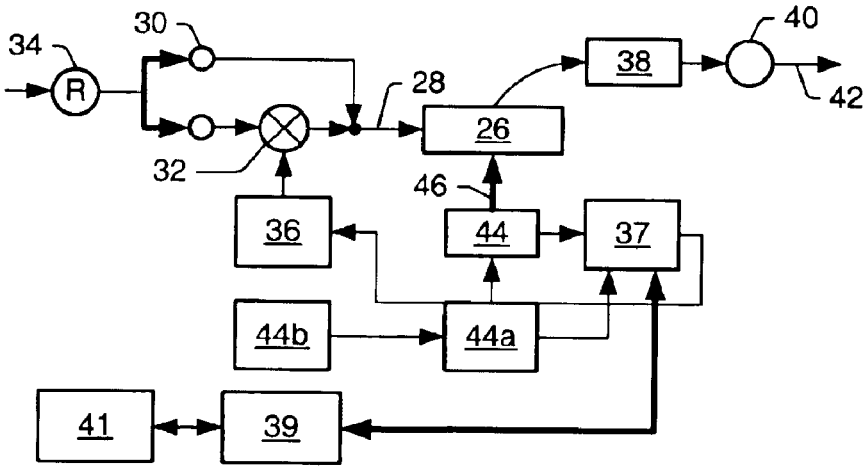
FIG. 2 depicts a schematic block diagram of an embodiment of a system configured to characterize, monitor, and/or control a polishing process.

FIG. 2 illustrates a schematic diagram of an embodiment of a system configured to characterize, monitor, and/or control a polishing process. The system includes sub-platen measurement device 26. Device 26 may include an electrical measurement device such as an eddy current based proximity sensor, which may be referred to hereinafter as an "eddy current device." The eddy current device may be configured to scan measurement spots in a line across the specimen during polishing of a specimen (not shown). The line may be substantially an entire lateral dimension of the specimen. The eddy current device may also be configured to scan the line across the specimen in a plurality of passes such that the measurement spots extend across an area approximately equal to an area of the specimen. In addition, the eddy current device may be configured to generate output signals responsive to both in-phase and quadrate eddy current components. The eddy current device may also be configured to generate output signals responsive to temperature-compensated thickness values such as a direct copper thickness value. The eddy current device may be configured to measure an electrical property such as conductance, resistance, and resistivity of the specimen at the measurement spots. An example of an eddy current device is illustrated in U.S. Pat. No. 5,552,704 to Mallory et al., which is incorporated by reference as if fully set forth herein.

An eddy current device may include at least one drive coil (not shown) and at least one sense coil (not shown) mounted within a housing (not shown). Each sense coil may be mounted in sufficiently close proximity to a drive coil (or coils) to allow mutual inductance measurements. One drive coil may be mounted in the housing, and one sense coil may be mounted in the housing coaxially with the drive coil. Alternatively, a single coil may function both as a drive coil and a sense coil. The eddy current device may be coupled to a voltage source configured to produce an AC voltage in the drive coil (preferably with a selected frequency in the range from about 100 KHz to about 100 MHz or higher). In addition, the eddy current device may be coupled to a meter configured to measure the amplitude of both the in-phase component and the quadrature component of the induced AC voltage in a sense coil (or coils) in response to AC voltage in the drive coil. A voltage source having a relatively high drive coil frequency (e.g., from 100 KHz to 100 MHz or higher) may be used with an eddy current device having a relatively small diameter probe (very small diameter drive and sense coils) to measure very small sample regions. For example, an average lateral dimension of measurement spots on a specimen may be less than about 6 mm. Therefore, relatively thin layers of a multilayer sample can be selectively measured by exploiting the phenomenon that, for a given eddy current device, the depth of the sample region measured depends in a well understood manner on the frequency of the AC voltage in the drive coil.

In addition, the system may include processor 39. The processor may be a computer system configured to operate software to control the operation of the eddy current device described herein. The processor may also be configured to receive output signals from the eddy current device. For example, processor 39 may be coupled to processor 37. Processor 37 may be a signal processor such as an analog/digital converter configured to receive output signals from the eddy current device. Processor 39 may be configured to determine a characteristic of polishing at the measurement spots on the specimen from output signals of the eddy current device.

In an embodiment, processor 39 may access a stored look-up table including a resistivity value determined by a resistivity function, for each of a number of different points on a selected curve. Each resistivity value may be retrieved from the stored look-up table by accessing a memory location indexed by a corresponding index voltage pair. In this manner, the resistivity of an "unknown" sample can be determined. For example, a lift-off curve is generated by producing an AC voltage in the drive coil while measuring both in-phase and quadrature components of the AC voltage induced in the sense coil, for each of a number of probe positions along an axis normal to the surface of the unknown sample. The separation between the sample and the probe (along the z-axis) need not be measured or otherwise known. The measured sense coil voltage pairs (each pair including an in-phase voltage and a quadrature voltage) may be processed to determine a lift-off curve. The processor may determine a "new" intersection voltage pair, which represents the intersection of the lift-off curve (for the unknown sample) with the selected curve employed during look-up table generation and identifies the resistivity of the unknown sample as a look-up table value it retrieves from the memory location indexed by the new intersection voltage pair.

In alternative embodiments, software for implementing the resistivity function itself may be stored in a memory coupled to the processor (rather than the described look-up table). In such alternative embodiments, the resistivity of an unknown sample may be determined as described above, except that rather than retrieving a stored look-up table value after generating a "new" intersection voltage pair for the unknown sample, the processor may determine the resistivity of the unknown sample by processing the new intersection voltage pair in accordance with the resistivity function. The resistivity determined from output signals of the eddy current device may be used to determine additional characteristics of the measurement spot on the specimen such as a thickness of a layer of material formed on the measurement spot. The layer of material may include, but is not limited to, a relatively thick metal.

In alternative embodiments, however, measurement device 26 may include a capacitive probe or a conductive polymer probe. In addition, the conductive polymer probe may be incorporated into the capacitive probe. Briefly, capacitance probes utilize insulated sensing electrodes, which may detect changes in distance between the probe face and the target surface. This distance, often referred to as the sensing gap, may be directly proportional to a change in capacitance. Electrical current flows from the probe face through the sensing gap and target. The circuit is completed by the target laying on an electrically grounded stage. By comparing the change in capacitance between a known sensing gap and the gap when an object of unknown thickness is placed beneath the probe face, a thickness may be calculated. Such capacitance probes are known in the art and are commercially available from, for example, MTI Instruments, Inc, Albany, N.Y.

Device 26 may also include a sub-platen optical device. Although the eddy current device and the optical device are shown to be included in device 26, it is to be understood that the eddy current device and the optical device may be physically separate and individually coupled to the platen (not shown). The optical device may be coupled to a self-clearing objective as described herein. The self-clearing objective may be disposed within a polishing pad of a polishing tool as described herein. Water line 28 may be configured to supply water to the self-clearing objective. The water line may be coupled to various control devices such as solenoid 30, which may be configured to turn the water on and off. The water line may also be coupled to flow controller 32, which may be configured to alter a flow rate of the water to the self-clearing objective. The solenoid and the flow controller may be coupled to water supply 34. Flow controller 32 may also be coupled to relay 36, and relay 36 may be coupled to processor 37. Relay 36 may be configured to control one or more parameters of the flow controller. Processor 37 may be a signal processor such as an analog/digital converter. Processor 37 may also be configured to receive output signals from device 26. The processor may provide the output signals to relay 36, which may alter a parameter of the flow controller in response to the signals from processor 37. Water and other chemicals present on the polishing pad may be collected in tank 38. Tank 38 may be coupled to pump 40, which may be configured to pump the water and other chemicals out of the tank and into drain 42.

In situ optical devices estimate the properties of specimen surface films by reflecting light off of the specimen during polishing. Some in situ optical devices use a single angle of incidence. The angle of incidence is often near normal incidence to the specimen thereby simplifying installation on a CMP tool. This type of device provides local reflectance measurements from which film properties may be deduced, and can be incorporated into portable process recipes. A chosen angle of incidence for a single angle of incidence device, however, may be acceptable for some films and processes, but may be unacceptable for others. Thus, the single angle of incidence optical device may work well for only a few processes. As an alternative, different process tools may be equipped with different optical devices appropriate for particular processes. Such an alternative, however, adds an extra degree of difficulty to scheduling of the CMP processes.

Multiple angle of incidence optical devices may address at least in part the above problems. In one embodiment, the sub-platen optical device may include, but is not limited to, a multiple angle of incidence reflectometer. The optical device may be configured to measure an optical property such as an optical reflectivity of the specimen at the measurement spots. The reflectometer may include eight light emitting diodes and eight photosensors. The reflectometer may, however, include any number of light emitting diodes and photosensors. The reflectometer may also be a spectroscopic reflectometer. Examples of reflectometers are illustrated in U.S. Pat. No. 5,486,701 to Norton et al. and U.S. Pat. No. 5,747,813 to Norton et al., which are incorporated by reference as if fully set forth herein. The optical device may be configured to scan measurement spots in a line across the specimen during polishing of the specimen. The line may be substantially an entire lateral dimension of the specimen. The optical device may also be configured to scan the line across the specimen in a plurality of passes such that the measurement spots extend across an area approximately equal to an area of the specimen. The optical device may further include a light source such as a laser coupled to a scanning assembly such as a mechanical scanner or an acousto-optical deflector. The system may also include an eddy current device and an optical device or a capacitance probe and an optical device. The eddy current device and the optical device, or the capacitance probe and the optical device such as a reflectometer, may be configured to operate in direct sensing, in situ modes. Therefore, in one embodiment, scanning the specimen may include measuring optical reflectivity and an electrical property at the measurement spots.

Figure 3:
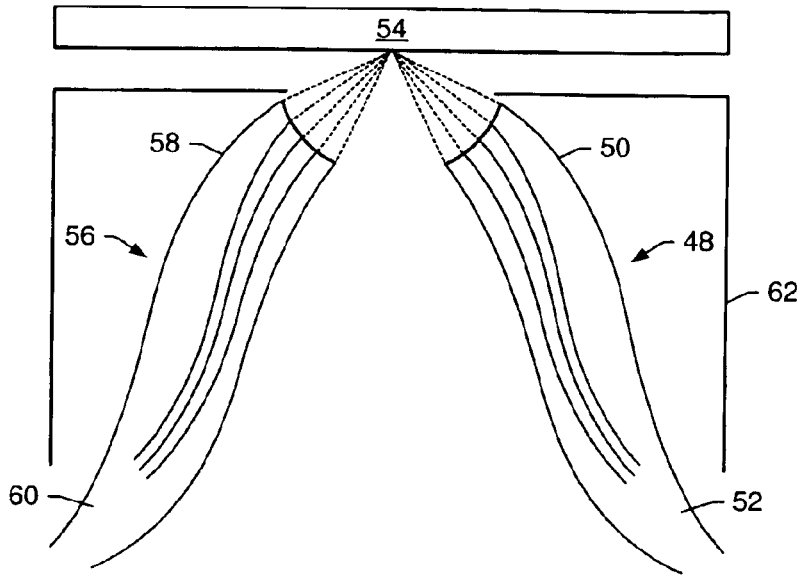
FIG. 3 depicts a schematic diagram of a side view of an embodiment of a light source that includes fiber optic bundles.

A reflectometer or another optical device may include light source 44. Light source 44 may be coupled to power supply devices 44*a* and 44*b*. Light source 44 may be coupled to fiber optic bundle 46 configured to direct light emitted from the light source such as a laser to a surface of a specimen (not shown). In an embodiment, the fiber optic bundle may be bent, as shown in FIG. 3. For example, fiber optic bundle 48 may be arranged such that first portion 50 of bundle 48 is at an angle to second portion 52 of bundle 48. Such an arrangement of the fiber optic bundle may simplify the optical path of the reflectometer. The reflectometer may also include lenses (not shown) coupled to each fiber optic element of the fiber optic bundle. The lenses may be incorporated into the fiber optic elements or may be coupled to the bundle. The lenses may be configured to focus light propagating from the fiber optic elements onto a surface of specimen 54. Alternatively, the fiber optic bundle may not include such lenses.

The reflectometer may also include fiber optic bundle 56. Fiber optic bundle 48 and fiber optic bundle 56 may be disposed within housing 62. Light returned from the surface of specimen 54 may be collected by fiber optic bundle 56. Fiber optic bundle 56 may be arranged such that first portion 58 of bundle 56 is at an angle to second portion 60 of bundle 56. Such an arrangement of the fiber optic bundle may simplify the optical path of the reflectometer. The reflectometer may also include lenses (not shown) coupled to each fiber optic element of the fiber optic bundle. Alternatively, the fiber optic bundle may not include such lenses. The lenses may be incorporated into the fiber optic elements or may be coupled to the bundle. The lenses may be configured to focus light propagating from the surface of specimen 54 onto a detector (not shown) coupled to the fiber optic bundle. The detector may include a diffraction grating. The diffraction grating may be configured to disperse light returned from the surface of the specimen. The dispersed light may be directed to a spectrophotometer such as a detector array. The detector array may include a linear photodiode array. The light may be dispersed by a diffraction grating as it enters the spectrophotometer such that the resulting first order diffraction beam of the sample beam may be collected by the linear photodiode array. The photodiode array, therefore, may measure a reflectance spectrum of the light returned from the surface of the specimen.

As described above, the optical device may also include a spectrophotometer. In this manner, the optical device may be used to determine a characteristic of structures having different optical properties. In addition, the optical device may be used to scan measurement spots having an area that includes at least two proximate structures having different optical properties. The spectrophotometer may also be configured to detect light reflected from the specimen at substantially zero-order. In addition, the optical device may include a microscope based spectrophotometer coupled to a CCD camera.

Processor 39 may also be configured to operate software to control the operation of the optical device as described herein. In an embodiment, the processor may be configured to alter a focusing setting of the optical device. For example, the processor may be configured to determine a thickness of a polishing pad used for the polishing process. The thickness of the polishing pad may be determined from output signals of a measurement device such as an eddy current device, an optical device, or an additional device coupled to the system. In addition, the thickness of the polishing pad may be determined as described above in other embodiments. The processor may be configured to alter a focus setting of the optical device in response to the thickness of the pad. In addition, the processor may be configured to determine a rate of wear of the polishing pad and may alter the focus setting in response to the rate of wear. The polishing pad may include a fixed-abrasive polishing pad or any other polishing pad known in the art. Such polishing pads may have a relatively large reduction in thickness (i.e., about 10 mm) over time due to polishing. Therefore, a focus setting of an optical device may change substantially over time. As such, the processor may compensate for polishing pad thickness loss such that the measurements of the optical device are not adversely affected by an out-of-focus condition.

Figure 4:
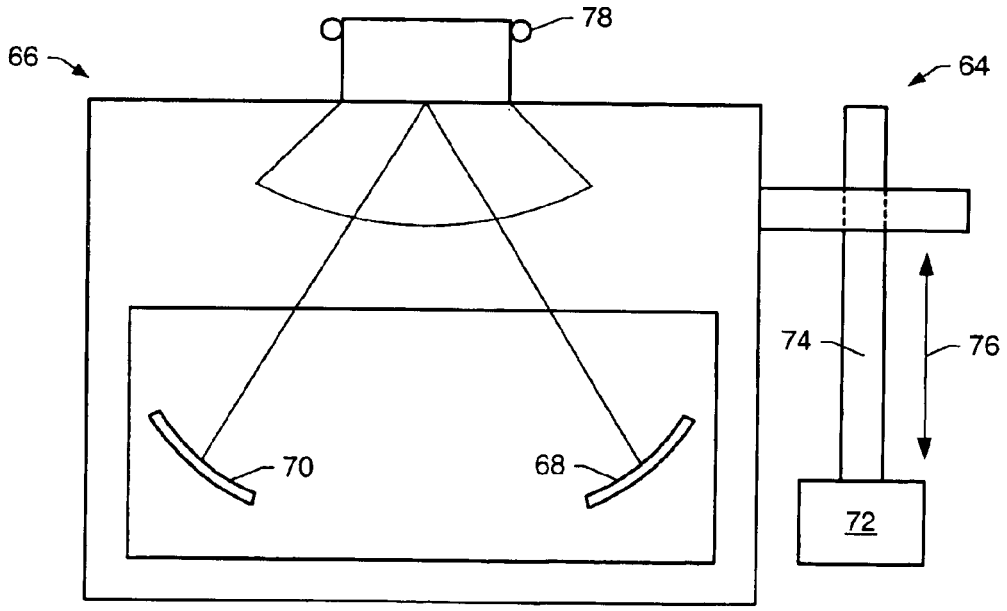
FIG. 4 depicts a schematic diagram of a side view of an embodiment of a focusing device.

FIG. 4 illustrates a schematic diagram of an embodiment of a focusing device, which may be coupled to processor 39. Focusing device 64 may be coupled to fiber optics assembly 66. Fiber optics assembly 66 may include fiber optic bundles as described above. The fiber optics assembly may also include light source 68 such as a laser and detector 70. The light source and the detector may be further configured as described above. Focusing device 64 may include stepper motor 72 coupled to lead screw 74. Stepper motor may be coupled to processor 39 such that the processor may control the stepper motor to move the fiber optics assembly bi-directionally along vector 76 in response to a thickness of the polishing pad or a rate of wear of the polishing pad. In this manner, the processor may control the stepper motor to move thereby altering a position of the fiber optics assembly. The fiber optics assembly may also be coupled to a window (not shown) disposed within a polishing pad (not shown) such as a self-clearing objective, which may be configured as described herein. Fluid from the self-clearing objective may be prevented from flowing into the fiber optics assembly by seal 78 disposed proximate an interface of the fiber optics assembly and the self-clearing objective. In addition, the fiber optics assembly may be coupled to one of the windows illustrated in FIGS. 1*a*–1*m*. In this manner, the window may compress in response to altered positions of the fiber optics assembly.

The processor may be configured to receive output signals from the optical device. For example, as shown in FIG. 2, processor 39 may be coupled to processor 37, which may be a signal processor such as an analog/digital converter configured to receive output signals from the optical device. The processor may be configured to determine a characteristic of polishing at the measurement spots on the specimen from output signals of the optical device. For example, the processor may be configured to obtain a relative reflectance spectrum by dividing the intensity of the returned light of the reflectance spectrum at each wavelength by a relative reference intensity at each wavelength. A relative reflectance spectrum may be used to determine the thickness of various films on the specimen. The films may include, but are not limited to, a relatively thin metal and a dielectric material.

In addition, the reflectance at a single wavelength and the refractive index of the film may also be determined from the relative reflectance spectrum. Furthermore, a multilayer modal method ("MMM") model may be used to generate a library of various reflectance spectrums. The MMM model is a rigorous diffraction model that may be used to calculate the theoretical diffracted light "fingerprint" from each grating in the parameter space. Alternative models may also be used to calculate the theoretical diffracted light, however, including, but not limited to, a rigorous coupled-wave analysis ("RCWA") model. The measured reflectance spectrum may be fitted to various reflectance spectrums in the library. The fitted data may be used to detect structures on the specimen from one or more output signals generated by scanning the specimen. In such an embodiment, the specimen may be scanned in a line across the specimen in at least two passes. The fitted data may also be used to determine a critical dimension such as a lateral dimension, a height, and a sidewall angle of a structure on the surface of a specimen as described herein. In addition, the fitted data may be used to identify structures on the specimen having a lateral dimension of less than about 1 $\mu$m from one or more output signals generated by scanning the specimen. Furthermore, output signals of a measurement device may be modeled on a time basis. In an embodiment in which polishing includes contacting a surface of the specimen with a slurry, the method may include modeling an effect of the slurry on output signals of a measurement device and reducing the effect of the slurry on the one or more output signals. Examples of modeling techniques are illustrated in PCT Application No. WO 99/45340 to Xu et al., which is incorporated by reference as if fully set forth herein.

Figure 5:
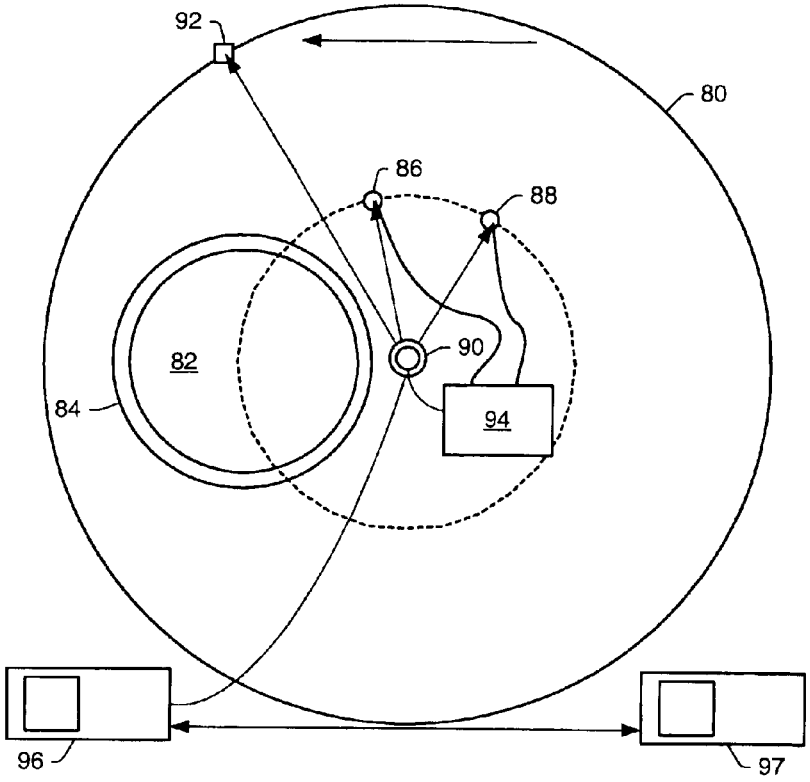
FIG. 5 depicts a schematic diagram of a top view of an additional embodiment of a system configured to characterize, monitor, and/or control a polishing process.

FIG. 5 illustrates a schematic diagram of a top view of an additional embodiment of a system configured to characterize, monitor, and/or control a polishing process. The system may include platen 80, which may be configured to rotate during polishing of specimen 82. A polishing pad (not shown) may be disposed upon the platen and contacts the specimen during polishing. The system may also include a polishing head (not shown). Carrier ring 84 of the polishing head may contain the specimen during polishing. The system may include eddy current device 86 and optical device 88, which may be configured as described herein. The eddy current device and the optical device may be spaced from a shaft of the platen and may be coupled to slip ring 90 on the shaft of the platen such that the eddy current device and the optical device rotate with the platen. In addition, the eddy current device and the optical device may or may not be coupled to windows formed within the polishing pad and platen 80. In this manner, the eddy current device and the optical device may scan over the specimen during polishing. The system may also include proximity sensor 92. Proximity sensor 92 may be configured to monitor a position of the eddy current device and the optical device relative to the carrier ring of the polishing head. The proximity sensor may also detect when a lateral position of the lead device, or sensor, (i.e., for counter-clockwise rotation, the eddy current device) is proximate, or nearing, a lateral position of the carrier ring thereby triggering the start of data acquisition.

The eddy current device and the optical device may be coupled to acquisition electronics 94. Acquisition electronics 94 may be configured to receive output signals from the eddy current device and the optical device. The electronics may also be configured to alter the output signals. For example, the electronics may include an analog/digital converter. In addition, acquisition electronics 94 may be coupled to processor 96. Processor 96 may be configured as described herein. For example, processor 96 may be configured to determine a characteristic of polishing, a presence of blobs on the specimen, an endpoint of the polishing from the output signals of the eddy current device and/or the optical device, and/or a two-dimensional map of the characteristic of the specimen from the output signals. The proximity sensor may also be coupled to the processor. In this manner, the proximity sensor may be configured to provide information to the processor regarding the position of the eddy current device and the optical device relative to the carrier ring of the polishing head. A polishing tool may include several such systems.

A processor as described in various embodiment herein may also be a computer system configured to operate a software algorithm, which may be configured to determine if blobs are present on the specimen at measurement spots on the specimen. The term, "blob," as used herein refers to unwanted material disposed upon a contiguous area on the specimen. The contiguous area may include a contiguous portion of the measurement spots on the specimen. A height of the blobs may vary across the contiguous portion. In addition, the processor may be configured to detect and locate only blobs having a lateral dimension within a predetermined range of lateral dimensions. The predetermined range may be determined, for example, by a user. The blobs may include copper and/or another material being removed from the specimen.

The processor may also be configured to locate and report, to control computer 97, blobs of varying thickness and spatial extent at measurement spots on a specimen. The presence of blobs on the specimen may be determined from output signals generated by scanning a measurement device such as an eddy current device or an optical device over the measurement spots as described above. For example, the algorithm may use information from the eddy current device, in situ, to directly determine a thickness of a metal such as copper on the specimen. Furthermore, processor 96 may also be configured to operate a software algorithm configured to determine a characteristic of polishing at measurement spots on the specimen or other information described herein from output signals of a measurement device such as an eddy current device or an optical device.

An eddy current device may have relatively high sensitivity to relatively thick films. In contrast, an optical device may have relatively high sensitivity to relatively thin films. Therefore, the output signals of both the eddy current device and the optical device may be used in situ to determine a thickness of a metal film over an entire range of thickness values present during a polishing process. In addition, an endpoint detection algorithm may be applied over an entire range of thickness values present during a polishing process using output signals of the eddy current device and the optical device. Therefore, an embodiment of a method as described herein provides non-destructive in situ detection of copper clear endpoint during polishing of a specimen. Furthermore, an embodiment of a method described herein may provide a substantially accurate estimate of a time at which complete copper removal occurs at localized specimen regions. The method thereby enables a processor coupled to a polishing tool to stop polishing of a specimen after copper is removed from the specimen. In another embodiment, the method may include determining an approximate endpoint of polishing if blobs are determined to be absent on the specimen and altering a parameter of the polishing in response to the approximate endpoint to reduce erosion and/or dishing of the specimen. For example, when the copper resists substantially complete removal, the method enables a processor to reduce, and even minimize, an amount of over-polishing on regions of the specimen in which the copper has been completely removed by the polishing process. As such, the improved endpoint detection and process control provided by the methods and systems as described herein may reduce dishing and erosion damage caused to a specimen by a polishing process.

Figure 6A:
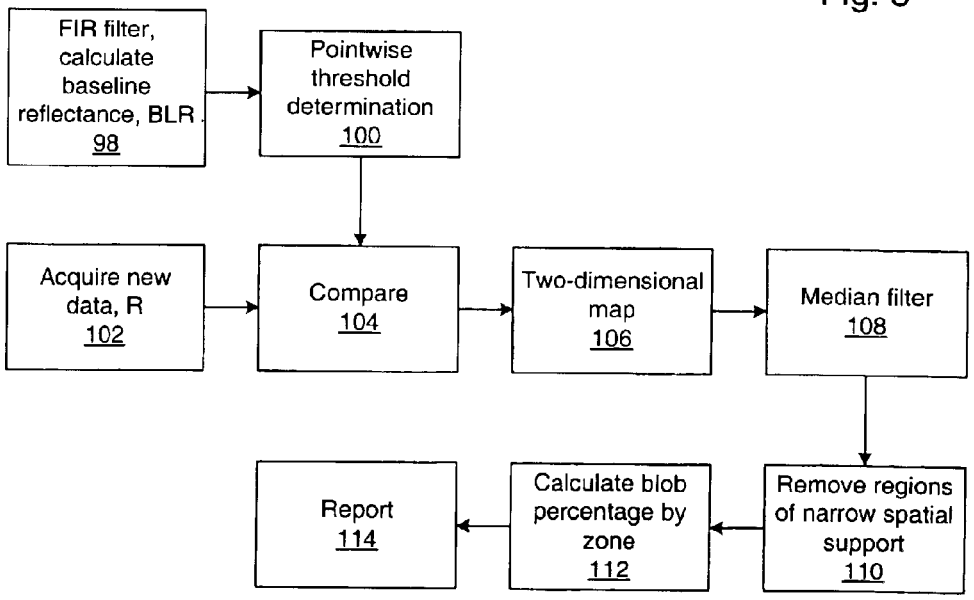
FIG. 6*a* depicts a flow chart illustrating an embodiment of a method for determining a presence of blobs on a specimen.

FIG. 6*a* is a flow chart illustrating an embodiment of a method for determining a presence of blobs on a specimen. The method may include using eddy current and optical device data, in combination, to determine copper clear process endpoints. The algorithm relies on the eddy current device when the copper is relatively thick. As a configurable setting, typically when about 200 nm, about 150 nm, or even about 80 nm, of copper remains on the specimen, the algorithm software examines the output signals of the optical device for signal features typical of copper clear endpoint. Such features may depend on a variety of process and wafer conditions, but typical features may include a pronounced drop and subsequent flattening in optical reflectance indicated by each sensor. As the eddy current device becomes relatively insensitive to very thin copper films (i.e., copper films having a thickness below about 30 nm) the algorithm software relies upon the optical device for final determination of copper clear endpoint.

As shown in step 102, the method may include selecting a plurality of sensors for the acquisition of new data, acquiring the data, and combining reflectance data of the sensors to provide a composite reflectance value, R, for measurement spots scanned across the specimen. For example, a reflectance may be calculated for each sensor using mirror and background file calculations pointwise over the optical device data. In addition, the reflectance for each sensor may be added, and the total may be divided by the number of optical sensors in use to obtain the composite reflectance value. As shown in step 104, the composite reflectance may be compared to a threshold. Values above the threshold may be determined to indicate a presence of blobs on the specimen. Values below the threshold may be determined to indicate a substantial absence of blobs on the specimen. As shown in step 106, the method may include generating a two-dimensional map indicating a presence or a substantial absence of blobs on the measurement spots across the specimen. The map may include a binary array that includes a 1 when the composite reflectance value is above the threshold and a 0 when the composite reflectance value is below the threshold. In some embodiments, the two-dimensional map may be further generated and configured as in other embodiments described herein.

Verification of the algorithm assumption may be known from a prior calibration and verification process set up step. As shown in step 98, the calibration and verification of an optical device may include using a finite impulse response (FIR) filter and determining a baseline reflectance (BLR). The BLR calculation may include calculating a composite reflectance value as the optical device scans the specimen to acquire new data. The calculation may also include accumulating spotwise values for a certain time interval after monitoring of the optical device data for an endpoint has begun. In addition, the calculation may include averaging the accumulated sum when the baseline interval is over. Furthermore, such a calculation may include an optional step of waiting until a percentage (i.e., about 75%) of each zone has a decreasing composite reflectance value and then performing the average described above. Alternatively, the BLR calculation may include finding a maximum composite reflectance value and using that as the baseline value. In this manner, the system may be self-calibrating. As shown in step 100, a threshold may be determined at each measurement spot on the specimen from the BLR calculation. In this manner, the method may include dynamically determining a signal threshold distinguishing a presence of the blobs from an absence of the blobs. Such a threshold may be used in step 104 described above. In addition, such a threshold may be used to determine if blobs are present on the specimen by comparing any output signals generated by scanning the specimen to the signal threshold to determine if a portion of a blob is present on the measurement spots. Such a threshold may also effectively reduce effects of a slurry used for polishing or other chemicals and materials on the output signals.

A non-linear filtering operation may be used to remove small gaps and spikes in the two-dimensional map illustrating a presence of copper on the specimen. For example, as shown in step 108, a median filter may be used to remove spikes in the two-dimensional map. In addition, as shown in step 110, a filter may be used to remove regions of narrow spatial support. Where relatively large regions, called blobs, of copper are indicated in the two-dimensional map, the software algorithm determines that there is copper remaining on the specimen that needs to be polished. Step 112 of the method may include calculating blob percentage present by zone. In an example, suppose each zone is about 20 spots wide, and the width threshold is about 20%. In this example, a zone has to have at least about 20% of the 20 spots having unwanted material present thereon to qualify as a blob. The percentage of copper blob in the zone is the number of spots in the blob divided by the width of the zone. The method may also include resolving blobs on the specimen at or near sensor resolution and reporting the spatial extent and locations on the specimen of the same, as shown in step 114. In this manner, such a method may provide finer resolution than methods that use filtering or other averaging schemes. In addition, such a method may provide finer resolution than methods that including binning of data.

The method may also include determining an endpoint of polishing if blobs are not determined to be present on the specimen. For example, when no sufficiently large blobs are present in the copper present map, the algorithm software considers the specimen to be cleared and an endpoint of the polishing process to be reached. This endpoint may be considered to be an approximate endpoint. After determining such an approximate endpoint of the polishing, the method may include altering a parameter of polishing such that the measurement spots may extend across an area approximately equal to an area of the specimen. For example, a speed of the polishing may be reduced in response to the approximate endpoint by reducing a rotational speed of the polishing head and/or platen. Algorithm options may exist in the method for configuring the minimal spatial extent of copper blobs, the areas of the specimen in which to search for copper regions, the number of times that such selected regions must be verified as clear before endpoint is determined, as well as hysteresis factors that may override a previous decision that a wafer region has cleared. For example, the algorithm may be configured to determine the number of times that a specimen, or regions of the specimen, may be scanned before endpoint is indicated to ensure complete specimen coverage. In this manner, the measurement device may scan across multiple paths on the specimen without prematurely indicating endpoint. The algorithm software reports the status of each specimen region as clear or not clear of copper, and a controller computer coupled to the polishing tool continues or terminates the polishing process as appropriate.

The utilization of the eddy current device is an advantage of the methods described herein. It allows the rapid removal of relatively thick copper, controlled by the temperature compensated direct thickness measurement. The utilization of a multi-angle optical device is also an advantage of the systems and methods described herein. The multi-angle optical device may include a number of sensors and may be configured as described herein. For example, the optical device may include eight sensors. Output from each of the sensors may be processed separately. Alternatively, output from eight sensors may be combined for increased signal-to-noise ratio. Such increased signal-to-noise ratio may mitigate the effects of some slurries on the output signals and may be an advantage with patterned specimen where the output signals of the optical device may contain significant specimen pattern noise.

In addition, the method may include selectively enabling or disabling optical sensors according to their angle of incidence and characteristics of a film stack on a polished specimen to improve the dynamic range of optical signals over the copper clear process time period. For example, some angles of incidence may be more effective than others during certain types of processing. All of the sensors may produce strong, high contrast signals when polishing specimen at the first patterning step. Later, as the number of metal layers increases, and the effective coverage of the specimen with copper grows, the higher angle of incidence sensors may be disabled in the process recipe to boost the signal dynamic range over copper clear endpoint.

Multiple sensors may also provide a certain amount of hardware redundancy in case of equipment failure as well. The software algorithm may be designed for maximum resolution of blobs, within the limitations imposed by the signal acquisition hardware. Typically, blobs-present resolution on a 300 mm wafer may be about 2 mm per sample, which is within the range required for adequate process control.

An additional embodiment of a computer-implemented method may also be used to determine an endpoint of a polishing process using output signals of an eddy current device and an optical device. Such a method may be used, in one example, to determine an endpoint of a tungsten polishing process. The method may include filtering acquired output signals from the eddy current device and the optical device, if necessary, to reduce noise components in the signals and to obtain smooth signal traces. The method may also include calculating average eddy current signal intensity and slope values. In addition, the method may include performing a self calibration of the optical device to remove background components and to scale the dynamic ranges of the output signals. The method may further include estimating a specimen circuit pattern density level by calculating optical signal statistics and setting algorithm parameters accordingly for blanket and patterned specimen. Furthermore, the method may include determining an average intensity and slope values for the optical signals.

In such an algorithm, eddy current signals may be used for tungsten removal detection only. When the eddy current signal intensity and the absolute value of the eddy current signal slope fall into specified threshold constraints for certain polishing cycles, the system may report the endpoint of tungsten removal. Optical signals may be used for both tungsten removal and barrier removal endpoints. The endpoint for tungsten removal may be reported when both the characteristics of the optical signal intensity and slope signals match the characteristics of tungsten removal for blanket and patterned specimen, respectively. Both intensity values and slope values of the optical signals may be used to detect the barrier removal. When the intensity values and the absolute values of the optical signal slopes both fall in their specified threshold constraints for certain polishing cycles, the algorithm may report the endpoint. In addition, the acquired data may be divided into several zones, and all of the above calculations may be applied to the zoned data if more spatial information about the polishing process is required.

In an alternative embodiment, the eddy current device alone may be used. In such an embodiment, the algorithm software determines copper clear endpoint after the output signal of the eddy current device flattens out for a sufficient period of time. This method is successful, and this is an effective method for a polishing tool that does not include an optical device. In another alternative embodiment, the optical device output signals are combined and then combined spatially in larger annular specimen regions called zones. In this embodiment, when the doubly averaged reflectance signals fall beyond a certain threshold, copper clear endpoint may be detected. Such an embodiment may be useful for a system that includes a self-clearing objective instead of a pad window and that uses a particularly opaque slurry. In yet another embodiment, the eddy current device output signals are used to project an expected copper clear time, and the optical device may be checked at this time for confirmation.

Figure 6B:
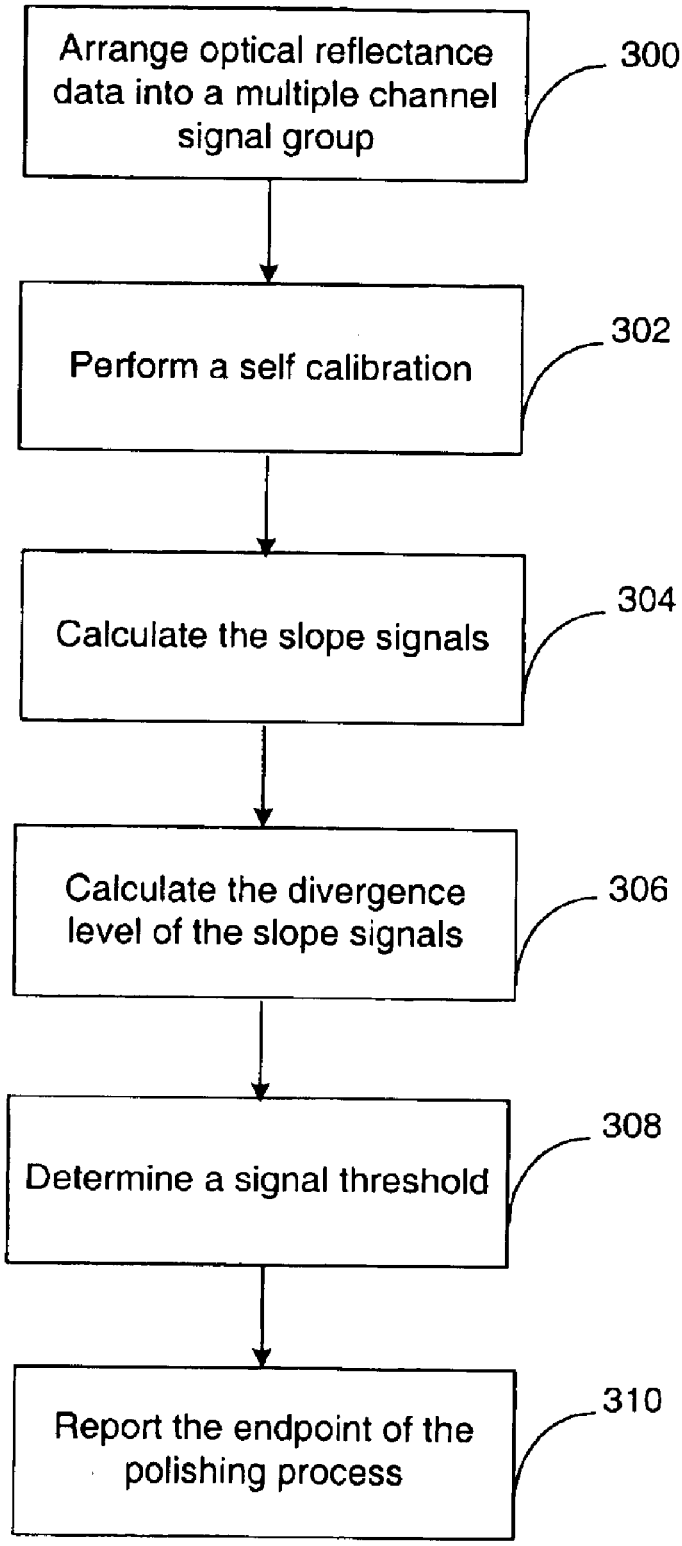
FIG. 6*b* depicts a flow chart illustrating an embodiment of a method for determining an endpoint of a polishing process.

FIG. 6*b* illustrates an embodiment of a computer-implemented method for determining an endpoint of a polishing process. For example, the algorithm may be used for non-destructive in situ endpoint detection of a polishing process such as shallow trench isolation (STI) CMP in semiconductor device fabrication. In addition, the determined endpoints may provide in situ control of polishing, which may be performed as described herein. Such control may improve STI CMP production processes in semiconductor device fabrication. The algorithm may be performed using output signals generated by a measurement device configured as described herein. For example, the output signals may be generated by a multi-angle reflectometer that may include a laser light source and a plurality of optical sensors coupled to a self-clearing objective or another pad window described herein. The acquired analog output signals may be digitized by processor 37, as shown in FIG. 2. The digitized signals may be sent to processor 39, as shown in FIG. 2, which may be configured to perform the algorithm described herein.

The method may include arranging optical reflectance data into a multiple channel signal group, as shown in step 300. The optical reflectance data may be generated as described herein. For example, the optical reflectance data may be acquired by scanning a multi-angle reflectometer over a specimen during a polishing process. The polishing process may be an STI CMP process. The multi-angle reflectometer may provide different optical response signals at different film thicknesses, which may provide the foundation for this algorithm. The method may also include performing a self calibration, as shown in step 302. Performing the self-calibration may include estimating signal backgrounds using data from certain initial scans and performing the self calibration on the optical signals to automatically remove the background levels and to scale the signals. In this manner, the various effects of the optical sensor system on the signal dynamic range may be effectively reduced.

In addition, the method may include calculating the slope signals, as shown in step 304. Calculating the slope signals from the optical reflectance signals may include dividing the acquired signals into a number of zones, and the slope signals may be calculated for the zones. The method may further include calculating the divergence level of the slope signals, as shown in step 306. Such a calculation may produce a smooth region before the endpoint and a relatively large and sharp increase in the divergence signal level at the interface between two layers on the specimen. The two layers on the specimen may include, for example, silicon dioxide and silicon nitride. These features may be used for the threshold determination and reporting the endpoint as described herein. Furthermore, the method may include determining a signal threshold, as shown in step 308. Determining a signal threshold may include calculating and scaling the mean value of the smooth region of the divergence level signal. Since the signal is smooth in this region, the determination of the threshold is relatively easy and stable. When the optical reflectance signals are further divided into zones, different thresholds may be determined for these zones.

The method may also include reporting the endpoint of the polishing process, as shown in step 310. The endpoint may be reported when the divergence signal increases sharply above the determined threshold. Since the divergence signal has a relatively large change in slope at the layer interface, endpoint detection using this algorithm may have relatively good resolution. When optical reflectance signals are divided into zones, the endpoints may be reported when the divergence signals for these zones are greater than the determined thresholds for these zones. The algorithm described above may be relatively insensitive to different film structures and the wavelength used for the optical system. Therefore, the algorithm may be widely applicable for polishing processes including, but not limited to, STI CMP.

The method described above may also include altering a parameter of polishing in response to the determined presence of blobs on the specimen using a feedback control technique, a feedforward control technique, and/or an in situ control technique. In addition, the method may include altering a parameter of an instrument coupled to a polishing tool other than the one used for polishing the specimen in response to the determined presence of blobs on the specimen using a feedforward control technique. For example, a processor such as processor 39 shown in FIG. 2, processor 96 shown in FIG. 5, and processor 142 shown in FIG. 10 may be configured to determine a presence of blobs on the specimen. The processor may be coupled to a controller computer using any method known in the art such as a serial line and a computer network such as the Internet. The processor may provide information about the presence of blobs on the specimen to the controller computer such as controller computer 41 shown in FIG. 2, control computer 97 shown in FIG. 5, and polishing tool host computer 144 shown in FIG. 10. Alternatively, processor 39, processor 96, and processor 142 may be configured to perform the functions of a controller computer as described herein.

Each of the controller computers may be coupled to a polishing tool. In addition, each of the controller computers may be configured to alter a parameter of the polishing tool in response to the information about the presence of blobs on the specimen. In addition, the controller computer may be configured to alter a parameter of polishing in response to the presence of blobs on the specimen or another characteristic of polishing to reduce within specimen variation of the characteristic. Such a parameter may be altered using an in situ control technique. For example, on polishing tools equipped with mechanisms for local control of specimen polish rates, such as variable downforce polishing heads, the determined presence of blobs on the specimen may be used to alter the polish rates on regions of the specimen upon which blobs are not present but to not alter the polish rates on regions of the specimen upon which blobs are present during polishing using an in situ control technique.

A measurement device trajectory over a specimen varies as platen and polishing head speeds and oscillation vary. Therefore, there is no guarantee that all parts of the specimen will be scanned by the measurement device during a process. A processor as described in various embodiments herein, however, may be configured to operate a software algorithm configured to determine relative locations of the measurement spots on the specimen. As such, the radial symmetry assumption (i.e., the property of the specimen is assumed or computed to be constant at a given radius, independent of theta) of other data processing schemes and approaches is not used. As such, the method may improve the performance of a polishing process by accommodating asymmetries, improving user feedback and display, and identifying and displaying asymmetry related process issues.

The algorithm may map the sensor path of a measurement device over a rotating specimen, which may be held in a carrier of a polishing head, as the measurement device mounted under the rotating polishing platen scans the specimen. In this manner, the algorithm may determine a representative scan path of the measurement device. By monitoring the precession of the sensor paths around the edge of the specimen in successive revolutions of the platen, the algorithm may determine an average spacing between starting points of individual scans of the measurement device. Therefore, the algorithm may use the representative scan path and the average spacing between starting points of individual scans to determine relative locations of the measurement spots on the specimen. In this manner, the algorithm may generate a full specimen surface, two-dimensional, map of a characteristic of the polishing process such as optical reflectance and metal thickness at the relative locations of the measurement spots. The characteristic may also include a thickness of a thick metal on the specimen, a thickness of a thin metal on the specimen, a thickness of a thin dielectric on the specimen, or a thickness of a thin film on the specimen. As used herein, the term "thick" is used to refer to thicknesses of a film or material at which the film or material is substantially opaque to a wavelength of light. In contrast, as used herein, the term "thin" is used to refer to thicknesses of a film or material at which the film or material is substantially transparent to a wavelength of light.

The two-dimensional map may be generated using polar coordinates or Cartesian coordinates of the relative locations. The processor may also be configured to use the two-dimensional map with a thin film model to determine thin film thickness values from optical reflectance data generated by a measurement device such as a reflectometer. Such spatially resolved reflectance and thin film thickness information may be transferred between processors configured to control separate platens as described herein. In addition, such spatially resolved information may be used to assess uniformity of the thin film thickness values or any other characteristic as described herein across the specimen. Furthermore, the two-dimensional map may be used to alter a parameter of polishing using a feedback control technique and/or using an in situ control technique. The two-dimensional map may also be used to alter a parameter of any polishing tool using a feedforward control technique.

Figure 7:
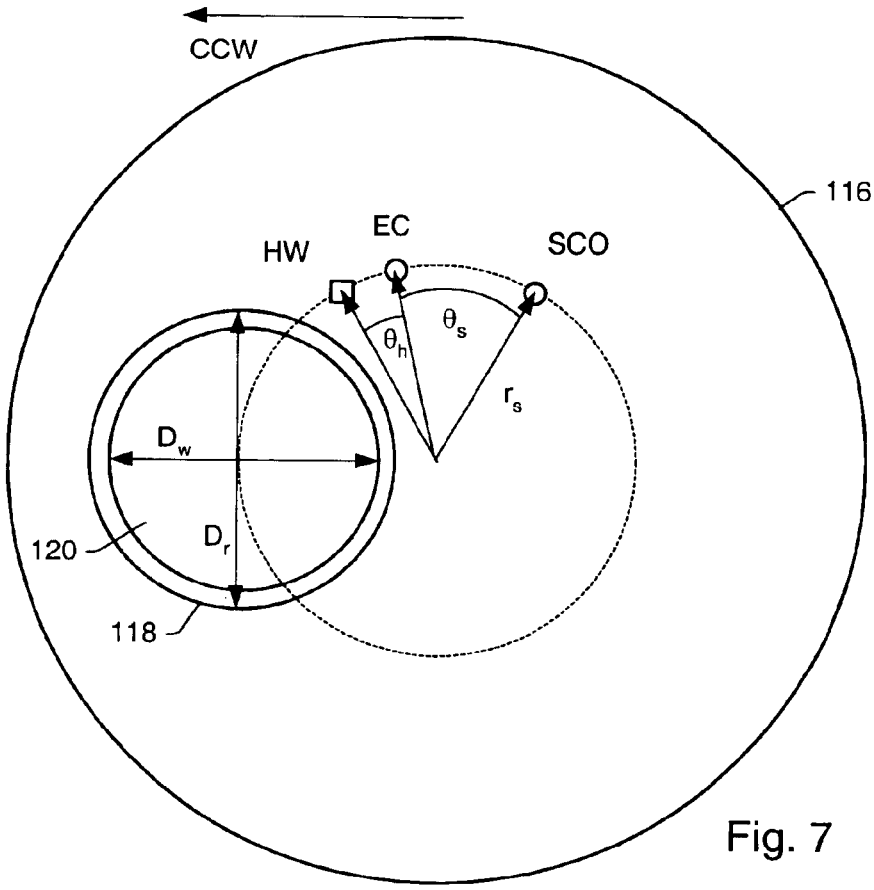
FIG. 7 depicts a schematic diagram of a top view of an embodiment of a measurement device configuration, platen geometry, and carrier geometry.

FIG. 7 illustrates a schematic diagram of an embodiment of a measurement device configuration, platen geometry, and carrier geometry. For example, platen 116 may rotate in a direction as indicated by vector CCW. Hardware HW may be coupled to the platen and may be angularly spaced from eddy current device EC by $\theta_h$. Eddy current device may be angularly spaced from optical device SCO by $\theta_s$. In addition, sensor radius path $r_s$ may be defined as a distance that the measurement devices are spaced from a shaft of the platen. Carrier ring 118 may have a diameter $D_r$, and specimen 120 may have a diameter $D_w$.

A computer-implemented method may be used to determine a path of a measurement device configured to scan a specimen as described herein. For example, when a carrier of a polishing head and a platen of a polishing tool rotate at $R_c$ and $R_p$ (RPM), respectively, their angular orientations may be defined by the following equations:

$$\omega(t)=2t\pi R_c/60\phi(t)=2t\pi R_p/60.$$

If the platen- and carrier-relative coordinate systems are (x, y) and (u, v), respectively, then the sensor path relative to (x, y) may be defined by the following equation:

$$P_{xy}(t)=\left(r_s\cos\left(\frac{2t\pi R_p}{60}\right),\ r_s\sin\left(\frac{2t\pi R_p}{60}\right)\right)$$

where r, is the sensor path radius. In (u, v) coordinates, with the carrier not rotating, this path may be defined by the following equation:

$$P_{uv}(t)=\left(r_s\cos\left(\frac{2t\pi R_p}{60}\right)-r_s,\ r_s\sin\left(\frac{2t\pi R_p}{60}\right)\right)$$

As such, after rotation by $\omega(t)$, the coordinates of the sensor over the wafer, relative to the (u, v) coordinate system may be defined by the following equation:

$$\begin{pmatrix}\cos(\omega) & \sin(\omega)\\ -\sin(\omega) & \cos(\omega)\end{pmatrix}\begin{pmatrix}r_s[\cos(\phi)-1]\\ r_s[\sin(\phi)]\end{pmatrix}=$$

$$r_s\begin{pmatrix}[\cos(\phi)-1]\cos(\omega)+\sin(\phi)\sin(\omega)\\ [\sin(\phi)\cos(\omega)-[\cos(\phi)-1]\sin(\omega)\end{pmatrix}$$

Figure 8:
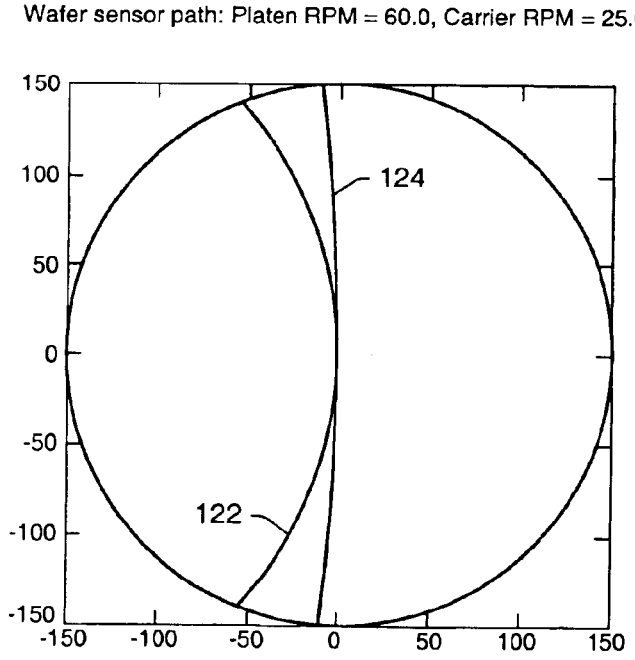
FIG. 8 depicts a plot of a representative scan path determined according to an embodiment of a method described herein.

According to the above method, therefore, a representative scan path may be determined, which may describe a relationship between two-dimensional coordinates of the measurement device during a scan and two-dimensional coordinates of a carrier, which may or may not rotate the specimen during the process. Representative scan path 122 determined according to the above method is illustrated in FIG. 8. The representative scan path was determined for a platen rotation speed of 60 rpm and a carrier rotational speed of 25 rpm. As shown in FIG. 8, the representative scan path is a relatively deeply curved arc. If a ratio of the platen rotational speed to the carrier rotational speed increases, the arc becomes shallower and approaches a diameter of the specimen as shown by representative scan path 124. As shown in FIG. 8, the measurement device may scan substantially an entire lateral dimension such as a diameter of the specimen in a single scan.

In general, the next sweep of a measurement device over the wafer will not follow the same path over the specimen. In addition, the eddy current and optical devices may scan measurement spots in different locations on the wafer. The new path may have substantially the same shape as the representative scan path, but, in general, it may start the scan on the specimen at a different point located proximate to a perimeter, or an outer lateral edge, of the specimen. The new path is found by computing the precession, $\Delta_c$, of the sensor path around the wafer, which may be defined by the following equation:

$$\Delta_c = 2\pi r_c\left(\frac{R_c}{R_p} - 1\right)$$

where $r_c$ is the specimen radius. In this manner, an average spacing between starting points of individual scans of the measurement device on the specimen may be determined. In addition, a path of a sequence of individual scans may be determined using the representative scan path and the average spacing between the starting points. The path of the sequence may describe a relationship between two-dimensional coordinates of the measurement device during the scan and two-dimensional coordinates of the specimen. Therefore, the path of a sequence of individual scans may be used to produce a spatially resolved, two-dimensional, surface map of the specimen. For example, output signals received from the measurement device may be associated with two-dimensional coordinates of the specimen using the path of the sequence. The two-dimensional coordinates may define relative locations of the measurement spots on the specimen. In this manner, a two-dimensional map of the specimen may be formed of metal thickness and optical reflectance using a non-destructive, in situ method.

A processor may use an accumulated sequence of individual scan paths to determine a percentage of the annular wafer regions, or the zones, covered by the sweep of the measurement device. The method may also be used to identify variations in a characteristic across the specimen due to a localized variation in a parameter of polishing using the two-dimensional map. As used herein, the term "localized variation in a parameter" is used to refer to a value of the parameter in one region of the specimen that is different from values of the parameter in other adjacent regions of the specimen. The value of the parameter may, in some cases, be an average value across a region. In addition, each of the regions may have an area less than a total area on the specimen. A specimen may divided into a number of regions, which may vary from 2 to the number of measurements spots on the specimen (i.e., each region is defined as one measurement spot).

In one example of a localized variation, if a polishing pad includes a self-clearing objective, the effect of de-ionized water flowing over the self-clearing objective on the polishing process may be assessed using the specimen coverage information. Other parameters associated with process endpoints such as hysteresis factors, over polish times, and recheck counts may also be assessed according to the zone coverage estimates given by the accumulated sequence of individual scan paths. Furthermore, one or more zones on the specimen having values of the characteristic outside of a predetermined range for the characteristic may be detected from the two-dimensional map. Lateral dimensions of zones having values of the characteristic outside of the predetermined range may also be determined from the two-dimensional map. In another embodiment, a parameter of polishing may be altered in response to variations in the characteristic across the relative locations to reduce within specimen variations of the characteristic. For example, in some embodiments, a zone on the specimen having an average value of the characteristic outside of a predetermined range may be detected, and a parameter of polishing within this zone may be altered in response to the average value of the characteristic.

A computer-implemented method may be used to characterize the process using the output signals of an eddy current device and an optical device. There is a time delay between when an eddy current device scans a position on the specimen and when an optical device scans the position on the specimen. This time delay may be determined as described herein and used to determine an accumulated sequence of individual scan paths for each device. In this manner, relative locations of the measurement spots of each device may be determined. Using the accumulated sequence of individual scan paths determined for each device, output signals generated by the eddy current device and output signals generated by the optical device may be correlated with one another at specific specimen locations at which the output signals have common two-dimensional coordinates. Therefore, a thin film model may be applied to reflectance output signals and eddy current output signals generated at common locations on the specimen.

A characteristic of the specimen may be determined from output signals of the eddy current device and a reflectometer using the thin film model. For example, output signals generated by a multi-angle reflectometer during a polishing process may be modeled by the reflectance and transmission through the optical objective of the reflectometer and a window in a polishing pad to the specimen. The specimen may include isotropic media $M_0, M_1, \ldots, M_{m+1}$; with complex refractive indices $N_0, N_1, \ldots, N_{m+1}$; where $M_0$ is the semi-infinite ambient (i.e., de-ionized water); $M_{m+1}$ is the semi-infinite substrate; $M_i$ has thickness $d_i$, $1 \leqq i \leqq m$; the angle of incidence is $\phi_0$; and the angle of refraction in $M_i$ is $\phi_1$, $1 \leqq i \leqq m+1$. The 2×2 scattering matrix is the product $S = I_{01}L_1I_{12} \ldots L_mI_{m,m+1}/(t_{01}t_{12} \ldots t_{m,m+1})$, where $L_i$ and $I_{i,i+1}$ are the layer and interface matrices:

$$L_i = \begin{bmatrix} e^{j\beta_i} & 0 \\ 0 & e^{-j\beta_i} \end{bmatrix} \quad I_{i,i+1} = \begin{bmatrix} 1 & r_{i,i+1} \\ r_{i,i+1} & 1 \end{bmatrix}$$

$\beta_i = [2\pi d_i N_i \cos(\phi_i)]/\lambda$. is the layer phase thickness; $\lambda$ is the wavelength; $t_{i,i+1}$ is either the p- or s-polarization Fresnel transmission coefficient:

$$t_{i,i+1,p} = \frac{2N_i\cos(\phi_i)}{N_{i+1}\cos(\phi_i) + N_i\cos(\phi_{i+1})}$$

$$t_{i,i+1,s} = \frac{2N_i\cos(\phi_i)}{N_i\cos(\phi_i) + N_{i+1}\cos(\phi_{i+1})}$$

and $r_{i,i+1}$ is either the p- or s-polarization Fresnel reflection coefficient:

$$r_{i,i+1,p} = \frac{N_{i+1}\cos(\phi_i) - N_i\cos(\phi_{i+1})}{N_{i+1}\cos(\phi_i) + N_i\cos(\phi_{i+1})}$$

-continued $$r_{i,i+1,s} = \frac{N_i\cos(\phi_i) - N_{i+1}\cos(\phi_{i+1})}{N_i\cos(\phi_i) + N_{i+1}\cos(\phi_{i+1})}$$

Figure 9:
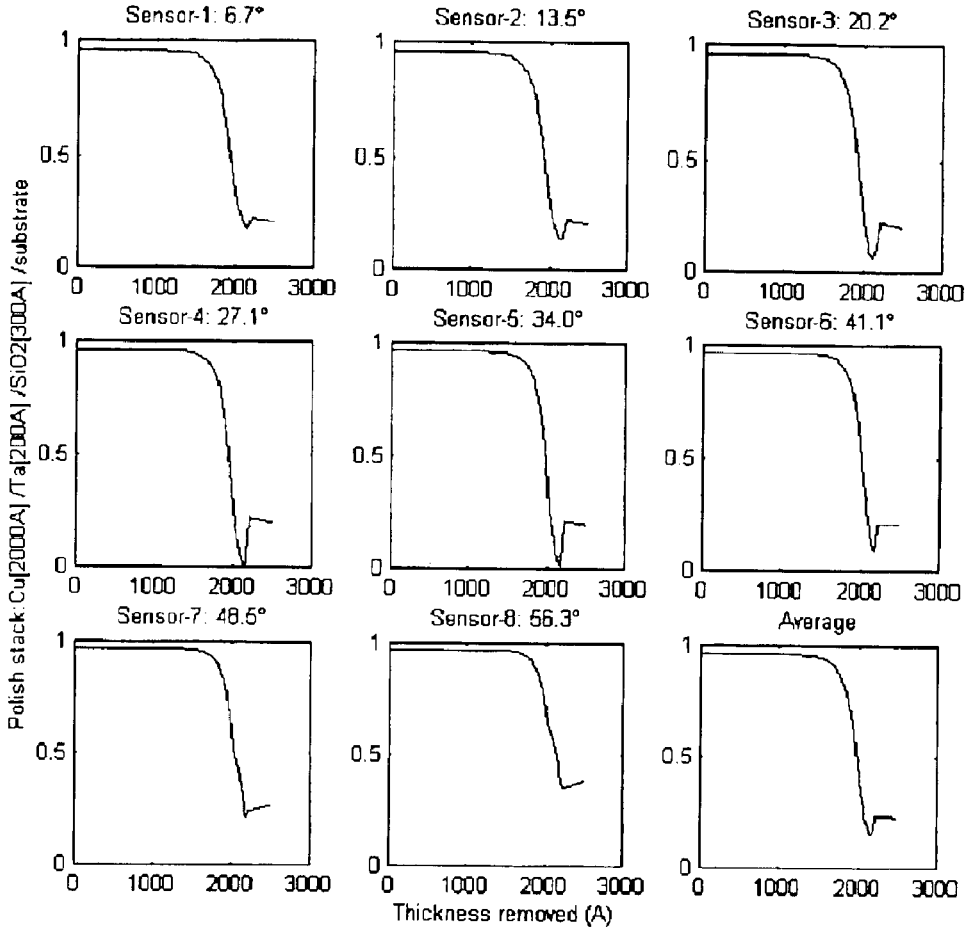
FIG. 9 depicts a number of plots of a sensor reflectance model for eight sensors having different angles of incidence.

Thus, via p- or s-polarization values, the wafer transmission coefficient is $t=(S_{11})^{-1}$, the reflection coefficient is $r=S_{21}/S_{11}$, and the reflectance is $R=|r|^2$. Varying a thickness of a layer, $d_i$, at a polish rate, $M_i$, of the layer and computing R at each step may produce a model of the polishing process. Reflectance values may be used as an index into a model curve for a plurality of sensors of a measurement device, as shown in FIG. 9, to estimate a thin metal thickness or a dielectric thickness remaining in a surface film. FIG. 9 illustrates a sensor reflectance model for eight sensors having different angles of incidence. The plots illustrated in FIG. 9 are representative of polishing a specimen that includes a copper layer having a thickness of about 200 nm. The copper layer is formed on a tantalum layer having a thickness of about 20 nm. The tantalum layer is formed upon a silicon dioxide layer having a thickness of about 30 nm, which is formed upon a substrate. The sensors may be incorporated into a multi-angle reflectometer as described herein. From a measured reflectance, indexing the ordinate (vertical) axis on any sensor model, through the intersection of the model trace, to the abscissa (horizontal) axis may be used to determine a thickness of a layer removed from the specimen. Thus, a two-dimensional map of optical reflectances may be converted into a two-dimensional map of thin film thickness values. Models of a plurality of sensors may be indexed using this same method to provide better signal to noise ratios for the thin film thickness computations, to cross-check results between sensors, and to confirm the removal of target surface layers by the polishing tool.

In addition, in systems that include an eddy current device and an optical device, the processor may be configured to use the eddy current thickness values during bulk removal of a film on the specimen to predict, in a spatially resolved manner, the final erosion of the thick film regions. The processor may also use the optical device measurements to detect clearing of all films in a likewise spatially resolved fashion. For example, a regression line may be fitted to thickness values at specimen locations determined from output signals of the eddy current device. The regression line may be used to estimate, or predict, an approximate endpoint of the polishing process or when the specimen will clear at locations on the specimen. Reflectometry data obtained from the optical device may be used to verify the estimated approximate endpoint. In addition, an endpoint may be determined from the two-dimensional map. Furthermore, an endpoint may be determined at individual measurement spots on the wafer from the two-dimensional map. The method may also include detecting an endpoint according to any other embodiments described herein.

In some polishing processes, some portions of the specimen may be cleared (i.e., complete target layer removal) while the target layer may remain on other portions of the specimen. For example, when a polishing process reduces film thickness values in an annular zone, some parts of the zone may contain a thin target surface film while other parts of the zone may not contain the thin target surface film (i.e., are clear). Estimates of film thickness from optical reflectance measurements are an important process parameter. However, currently available methods do not apply a thin film model separately to the clear part of the zone and that still containing target film. Therefore, measurements based on optical reflectance in these zones may be substantially inaccurate. In contrast, in an embodiment, the characteristic of the polishing process may be determined by applying a thin film model to output signals at a first portion of measurement spots upon which a film is absent. Such an embodiment may also include separately applying the thin film model to output signals generated at a second portion of the measurement spots upon which the film is present. For example, as described above, an endpoint may be detected at individual measurement spots on a specimen. Therefore, in one embodiment, the measurement spots at which an endpoint has been detected may be identified. The thin film model may be applied to these measurement spots and separately to other measurement spots at which an endpoint has not been detected. As such, characteristics determined from optical reflectance data in this manner may be substantially accurate.

In an embodiment, a two-dimensional map generated as described herein may be used to determine lateral dimensions of irregular material patches that resist uniform planarization during a polishing process such as blobs. A processor may also be configured to generate a two-dimensional map of the specimen as polishing of the specimen proceeds thereby removing films on the specimen and planarizing structures on the specimen. In this manner, the two-dimensional map may illustrate changes in characteristics of the films and structures at the relative locations of the measurement spots as the polishing proceeds.

Figure 10:
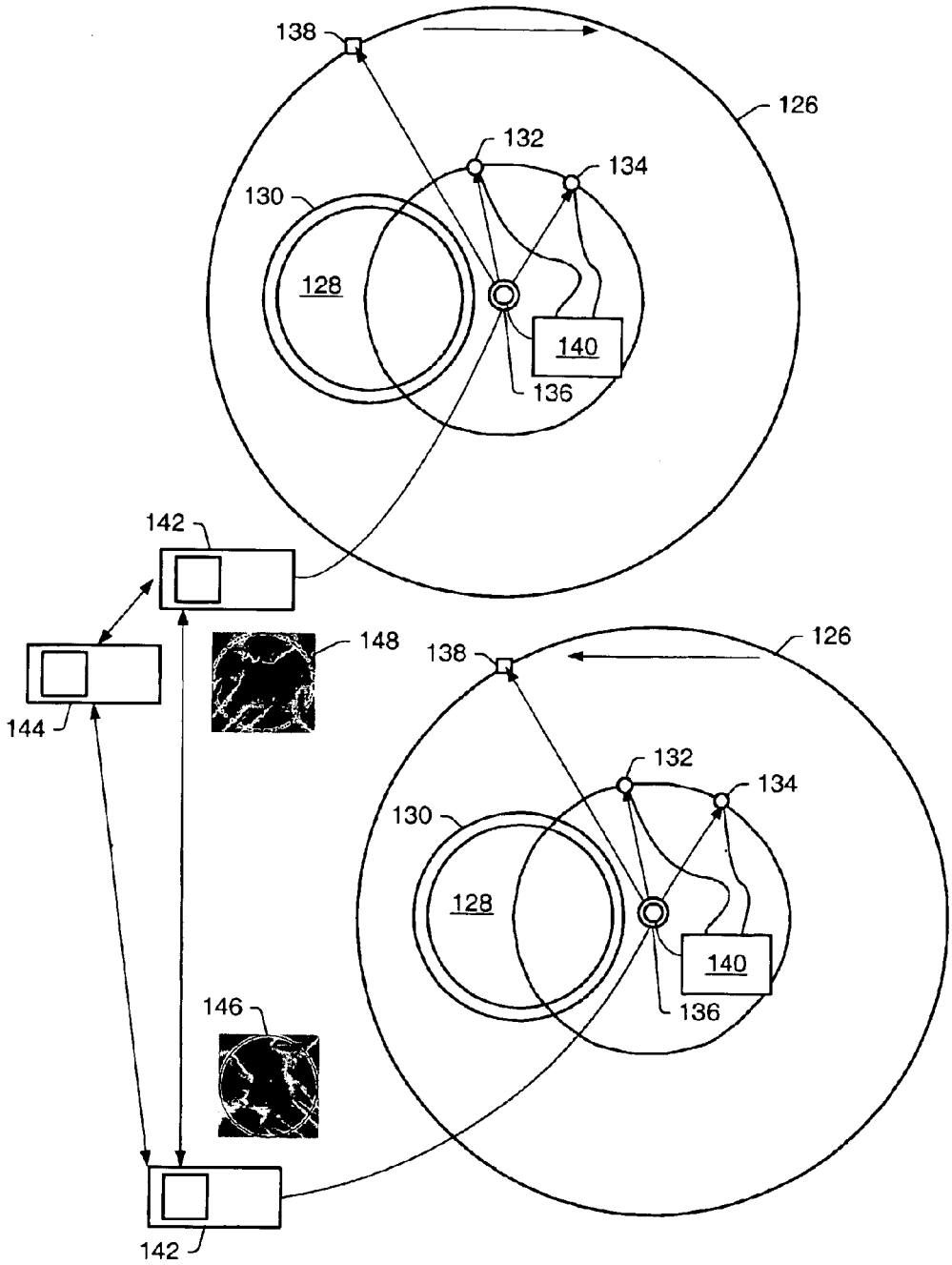
FIG. 10 depicts a schematic top view of an embodiment of a polishing tool that includes two platens.

FIG. 10 illustrates a schematic top view of a system configured to characterize, monitor, and/or control a polishing process. The system may include two platens 126, which may be configured to rotate during polishing of specimen 128. The two platens may be configured to perform different polish steps of a polishing process in a staged or pipeline fashion. A polishing pad (not shown) is disposed upon each platen and contacts the specimen during polishing. The system may also include a polishing head (not shown) coupled to each platen. Carrier ring 130 of each polishing head may reduce slippage of the specimen during polishing. Eddy current device 132 and optical device 134, which may be configured as described herein, may be coupled to each of the platen. The eddy current device and the optical device may be spaced from a shaft of the platen and may be coupled to slip ring 136 on the shaft of the platen such that the eddy current device and the optical device rotate with the platen. In addition, the eddy current device and the optical device may or may not be coupled to windows formed within the polishing pad and platen 126. In this manner, the eddy current device and the optical device may scan over the specimen during polishing. The system may also include proximity sensor 138. Proximity sensor 138 may be configured to monitor a position of the eddy current device and the optical device relative to the carrier. The proximity sensor may also detect when a lateral position of the lead device, or sensor, (i.e., for counter-clockwise rotation, the eddy current device) is proximate, or nearing, a lateral position of the carrier ring thereby triggering the start of data acquisition.

The eddy current device and the optical device may be coupled to acquisition electronics 140. Acquisition electronics 140 may be configured to receive output signals from the eddy current device and the optical device. The electronics may also be configured to alter the output signals. For example, the electronics may include an analog/digital converter. In addition, acquisition electronics 140 may be coupled to processor 142. Processor 142 may be configured as described herein. For example, each of the processors may be configured to control a polishing step performed on one platen. In addition, each of the processors may be coupled to an additional processor such as polishing tool host computer 144. Polishing tool host computer 144 may be configured to transfer information between each of the processors. For example, polishing tool host computer 144 may be configured to transfer final wafer surface map 146 from the first processor to the second processor. Alternatively, processors 142 may be configured to transfer information directly between the processors. As such, on a dual-platen polishing tool using a two-step polishing process, a two-dimensional map of spatially resolved metal thickness and optical reflectance information may be saved from the first process step and transferred to a processor configured to control the second process step. In this manner, the final wafer surface map 146 may be initial wafer surface map 148 of the second polishing step.

The surface map information may be misaligned with respect to the measurements taken during the second process step. A registration algorithm of the processor configured to control the second process step may resolve this discrepancy. The processor configured to control the second process step may use the two-dimensional specimen surface map to quickly register salient surface features of the rotating specimen while the second polish step progresses. Since the angular information on specimen features is not lost, but only offset from the two-dimensional map generated by the first step processor, the registration may be accomplished by any of a number of standard measures of matching between a sample data set and a prototype data set. In this manner, the second processor may alter an orientation of final wafer surface map 146 in response to an orientation of the specimen during the second process step.

In addition, each of the processors may be configured to determine a characteristic of polishing, a presence of blobs on the specimen, an endpoint of the polishing from the output signals of the eddy current device and/or the optical device. The proximity sensors may also be coupled to the processors. In this manner, the proximity sensors may be configured to provide information to the processors regarding the position of the eddy current device and the optical device relative to the carrier of the polishing head. A polishing tool may include any number of such systems. In addition, the polishing tool may be further configured as a cluster tool. An example of a polishing tool configured as a cluster tool is illustrated in U.S. Pat. No. 6,247,998 to Wiswesser et al., which is incorporated by reference as if fully set forth herein.

In a similar manner, the two-dimensional map may be correlated with an additional two-dimensional map of data generated by processing the specimen with an additional system such as a metrology system or a process tool. As such, the data generated during the polishing process may be used to calibrate and match multiple metrology systems within a fabrication facility. The data may also be provided to a metrology system such that a parameter of the metrology system may be altered using a feedforward control technique. In addition, the data generated during the polishing process may be used to provide information to the process tool such that a parameter of the process tool may be altered using a feedback or feedforward control technique.

Figure 11:
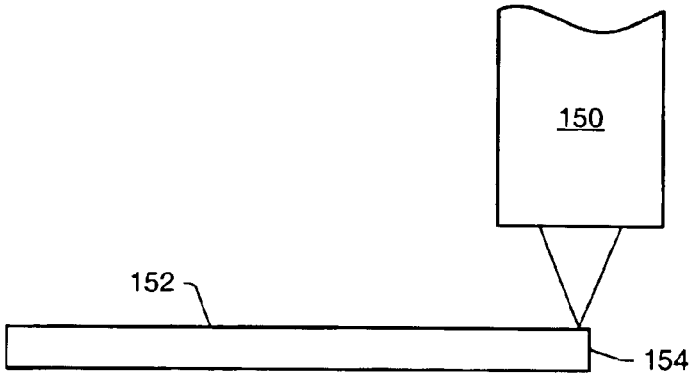
FIG. 11 depicts a schematic side view of an embodiment of a pre-aligner.
Figure 11A:
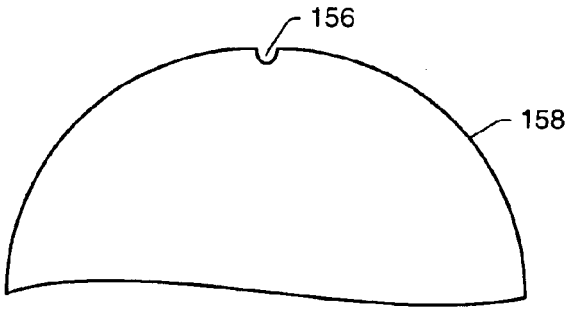
FIGS. 11*a*–11*c* depict schematic top views of a specimen including a notch, a flat, or an identification mark.
Figure 11B:
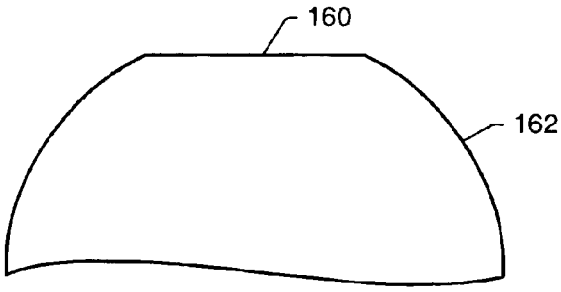
Figure 11C:
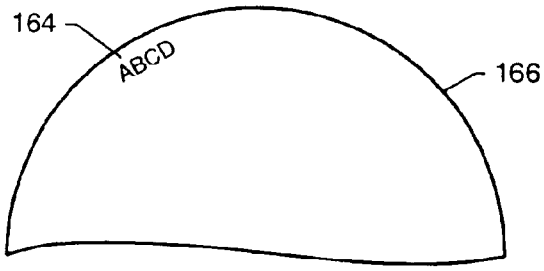

A polishing tool as described herein may also include a pre-aligner. A pre-aligner may be configured to optically detect a notch, a flat, or an identification mark of the specimen. For example, as shown in FIG. 11, pre-aligner 150 may be configured to illuminate a portion of specimen 152 proximate outer lateral edge 154 of the specimen. In addition, the pre-aligner may be configured to detect light returned from the portion of the specimen. The pre-aligner may be coupled to a processor that may be configured to analyze the detected light to detect the notch, flat, or identification mark and to determine a position of the notch, flat, or identification mark of the specimen. A notch, flat, or identification mark may include any indicia that is a permanent part of a substrate of the specimen such that the notch, flat, or identification mark does not change over time. FIG. 11*a* illustrates a top view of a portion of specimen 158 including notch 156. FIG. 11*b* illustrates a top view of a portion of specimen 162 including flat 160. FIG. 11*c* illustrates a top view of a portion of specimen 166 including identification mark 164.

A processor may be configured to determine absolute locations of measurement spots on the specimen. For example, the processor may determine absolute locations of measurement spots on the specimen by determining locations of the measurement spots relative to a location of a notch, flat, or identification mark detected as described above. In addition, the processor may assign coordinates to the measurement spots based on the relative locations of the measurement spots and coordinates of the detected notch, flat or identification mark. In this manner, a two-dimensional map of a characteristic of polishing at the absolute locations of the measurement spots may be generated. Such a two-dimensional map may be used to associate film characteristics such as metal thickness and optical reflectance measurements with absolute positions on the specimen. In this manner, such a two-dimensional map may be correlated with an additional two-dimension map of data generated by processing the specimen with an additional system. In another embodiment, if the polishing of the specimen is a first polish step of a polishing process, the two-dimension map may be provided to a processor configured to control a second polish step of the polishing process. In yet another embodiment, an orientation of the specimen may be altered in a second polish step of the polishing process using the two-dimensional map.

The processor may be further configured to record a time at which an endpoint of the polishing is detected. For example, the endpoint may be determined at a time at which copper is cleared from the specimen. The processor may also be configured to record a time at which an endpoint of polishing is detected at individual measurement spots on or in different regions of a specimen as described above. Therefore, an amount of time that cleared regions on a specimen have been unnecessarily polished, which may be commonly referred to as "over-polishing," may be determined. In this manner, over-polishing of the specimen at the absolute locations of one or more measurement spots may be determined from the end point and one or more parameters of the polishing. In a similar manner, over-polishing of the specimen may also be determined at relative locations of one or more measurement spots, which may be determined as described above. In addition, the processor may be configured to associate characteristics at individual absolute locations on the specimen with a die arranged on the specimen at the individual absolute locations. Furthermore, the processor may be configured to correlate characteristics determined as described herein, including over-polish amounts, with test results such as electrical test results of a semiconductor device formed on the specimen.

Over-polishing may produce erosion of a film on the specimen. Therefore, the method may also include generating a two-dimensional map of erosion of a film formed on the specimen due to polishing. In addition, a processor may be configured to reduce, and even minimize, an amount of over-polishing on regions of the specimen in which the endpoint has been reached by altering parameters of a polishing process or tool. As such, the improved endpoint detection and process control provided by the methods and systems as described herein may reduce dishing and erosion damage caused to a specimen by a polishing process.

A two-dimensional map generated using absolute locations of the measurement spots may be used to determine mathematically correct, two dimensional assessments of specimen non-uniformity parameters. Furthermore, a parameter of polishing at one of the absolute locations may be altered in response to the characteristic at the one absolute location to reduce within specimen variation in the characteristic. For example, on polishing tools equipped with mechanisms for local control of specimen polish rates, such as variable downforce polishing heads, the non-uniformity assessments may be used to alter the polish rates on regions of the specimen that are polishing too fast or too slow during polishing using an in situ control technique. An example of a polishing tool equipped with mechanisms for local control of polishing rates is illustrated in U.S. Pat. No. 6,146,259 to Zuniga et al., which is incorporated by reference as if fully set forth herein. The method may also include steps of any other embodiments described herein. For example, the method may include determining if blobs are present on the specimen as described above and further using the two-dimensional map.

Figure 12:
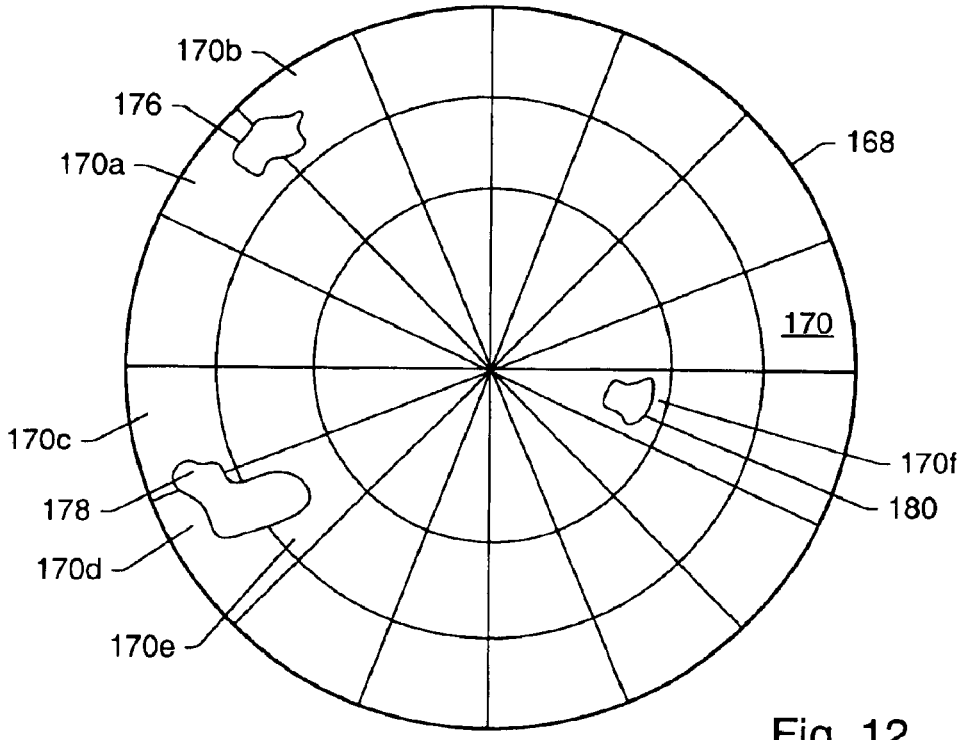
FIGS. 12 and 13 depict schematic plan views of various embodiments of a surface area of a specimen divided into a plurality of zones.
Figure 13:
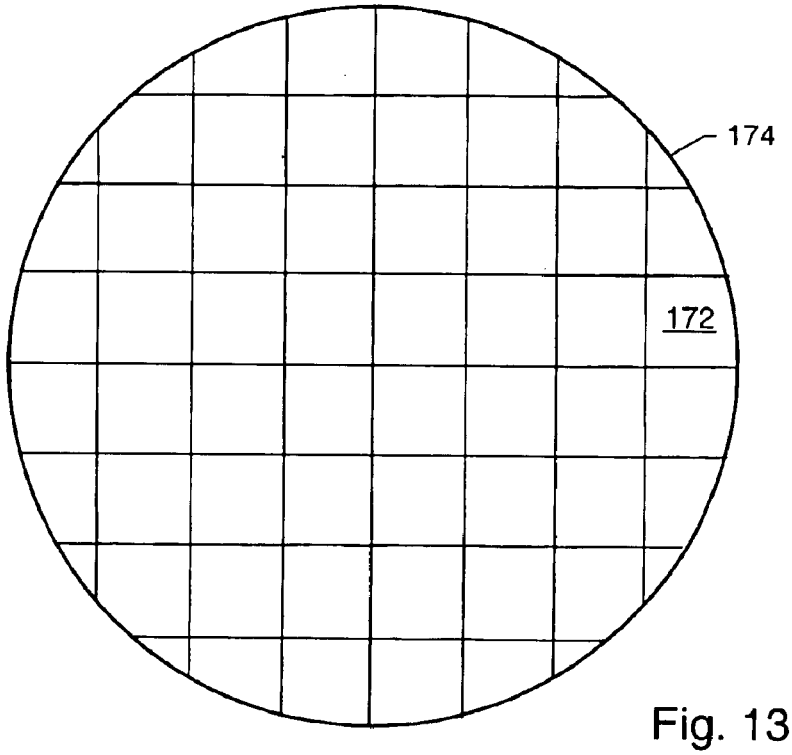

An additional embodiment relates to a method for characterizing polishing of a specimen. The method may include scanning the specimen with an eddy current device during polishing as described above to generate output signals at measurement spots across the specimen. The method may also, or alternatively, include scanning the specimen with an optical device during polishing as described above. Scanning the specimen with either device may include scanning substantially an entire lateral dimension of a specimen and/or scanning measurement spots across the specimen in a plurality of passes. The method may also include combining a portion of the output signals generated at measurement spots located within a zone on the specimen. For example, as shown in FIG. 12, a surface area of specimen 168 may be divided into plurality of zones 170. Each zone may include a predetermined range of radial and azimuthal positions on the specimen. The measurement spots within the zone may have radial and azimuthal positions on the specimen within the predetermined range. Alternatively, as shown in FIG. 13, each zone 172 may include a predetermined range of rectangular positions on specimen 174. Although the specimens illustrated in FIGS. 12 and 13 are shown to include a particular number of zones, it is to be understood that these figures are for illustrative purposes only and that a specimen may include any number of such zones (i.e., 2 to the number of measurement spots on the specimen).

Combining the portion of the output signals within a zone may include, for example, adding the values of the portion of the output signals and dividing the total by the number of output signals of the portion to determine an average value of the output signals within the zone. In addition, the method may include determining the characteristic of polishing within the zone from the combined portion of the output signals. The characteristic may be determined from the output signals as described herein. The characteristic may include, but is not limited to, a thickness of a structure such as a thin film formed on the specimen, a polish rate, and a polish uniformity.

The method may also include generating a two-dimensional map of the characteristic within the zone. The map may be generated as described herein. In addition, the method may include altering a parameter of polishing in response to the map. The parameter may be altered using a feedback control technique, a feedforward control technique, and/or an in situ control technique. The method may also include determining the characteristic of polishing at measurement spots across the specimen such as across substantially an entire area of the specimen. The method may also include generating a two-dimensional map of the characteristic across the specimen as described above and altering a parameter of the polishing in response to the map. The parameter may be altered in response to such a map using a feedback control technique, a feedforward control technique, and/or an in situ control technique.

In an embodiment, the method may include altering a parameter of polishing within a zone in response to the characteristic of polishing within the zone. In this manner, within specimen variation of the characteristic may be reduced. The parameter within the zone may be altered using a feedback control technique, a feedforward control technique, and/or an in situ control technique as described herein. In addition, the method may include altering a parameter of a polishing tool other than that used for polishing the specimen in response to the characteristic of polishing with the zone using a feedforward control technique.

In an embodiment, the method may include determining the characteristic of polishing within a zone and an additional zone on the specimen. Such a method may also include determining an additional characteristic of polishing from the characteristics of polishing within the zone and the additional zone. The additional characteristic may include, for example, a uniformity value of the characteristic across the two zones. The method may also include altering a parameter of polishing in response to the characteristics of polishing within the zone and the additional zone. As such, the parameter in the zone may be different than the parameter in the additional zone. For example, a variable downforce polishing head may be used to increase the polish rates within zones of the specimen having a relatively thick layer of material and to decrease the polish rates within zones of the specimen having a relatively thin layer of material during polishing using an in situ control technique.

An additional embodiment may include detecting a presence of blobs on the specimen as described herein. The blobs may be located across two or more adjacent zones on the specimen. For example, as shown in FIG. 12, blob 176 may be located across zones 170*a* and 170*b*, and blob 178 may be located across zones 170*c*, 170*d*, and 170*e*. Alternatively, a blob may be located wholly within a zone on the specimen. For example, blob 180 may be located entirely within zone 170*f*.

An embodiment of the method may also include comparing the characteristic to a predetermined range for the characteristic and generating an alert signal if the characteristic is outside of the predetermined range. For example, the predetermined range may be set manually or automatically using control limits for the characteristic. In addition, the alert signal may be any output signal that may be detected by a user of the polishing tool. Such an alert signal may include a visual signal, such as a flag used to identify the characteristic or an alert message, or an audible signal, such as a warning alarm. The user may or may not be located in a remote location from the polishing tool.

In alternative embodiments, the methods described herein may also be performed during other processes. For example, the methods described herein may be performed during a process including, but not limited to, removing material from the specimen, an etch process, a cleaning process, a deposition process, and a plating process, and any other process that involves rotation of the specimen during processing as described herein and as known in the art. In addition, the methods may further include steps of any other methods as described herein. For example, determining the characteristic of polishing within the zone may include modeling the combined portion of the output signals on a time basis.

Optical and/or eddy current data collected from the system may be used to monitor parameters other than those specific to the polishing process. For example, a failure or degradation in the measurement device such as failure of a light source, failure of a detector, or degradation of the transparent optical window may be detected by monitoring the optical signal measured on the system. In addition, optical background and specimen measurements may be used to monitor a presence of a specimen, optical path integrity, and electrical system operation. The eddy current signal may be particularly sensitive to breaks in conductive films formed on the specimen and may be, therefore, particularly sensitive to breaks in the specimen itself. Furthermore, optical data may be combined with eddy current data for advanced analysis of optical path and self-calibration of the measurement device.

In an embodiment, a method may include determining if the output signals generated as described herein are outside of a range of the output signals. Output signals to outside of a range may indicate that a parameter of a measurement device is outside of control limits for the parameter. For example, in one embodiment, the method may further include generating a signature characterizing polishing using output signals of a measurement device such as an eddy current device. In addition, the method may include determining if differences between the signature and a reference signature are outside of a range of the differences. Such differences may indicate that the parameter of the measurement device is outside of control limits for the parameter. The parameter of the measurement device may include a characteristic of light emitted by a light source of the measurement device. The characteristic may include an intensity, a wavelength, and an angle of the light. Alternatively, the parameter of the measurement device may include a characteristic of light detected by the measurement device. Light detected by the measurement device may pass through a window in a polishing pad prior to being detected. Therefore, the parameter may be sensitive to failures of a sensor of the measurement device and/or scratches on a window of a polishing pad, which may alter an angle of the light reflected from the specimen. Output signals determined to be outside of the range may also indicate an electrical failure of a measurement device.

In an embodiment, output signals determined to be outside of the range may be analyzed to assess a cause for the parameter of the measurement device to be outside of the control limits. For example, if electrical failure of the measurement device has occurred then the output signals outside of the range may have significantly different values than values of the output signals that would be caused by scratches on a window in a polishing pad. Therefore, the values of the output signals outside of the range may be used to identify one or more potential causes for the parameter of the measurement device to be outside of the control limits. Similarly, the values of the output signals may be used to eliminate one or more potential causes for the parameter of the measurement device to be outside of the control limits. In addition, the method may include determining a characteristic of an optical path of the measurement device from the output signals and output signals from an additional measurement device. For example, the output signals may be used to determine an angle of incidence of the optical path. In another example, the output signals may be used to determine if the optical path is being at least partially obstructed by slurry, particles, material polished from a specimen, and/or any other material that may be present during a polishing process.

In a further embodiment, the method may include calibrating the measurement device using the output signals as described herein. In an additional embodiment, the method may include altering a parameter of the measurement device if one or more of the output signals are determined to be outside of the range. Altering the parameter of the measurement device may include, for example, altering an amount of electricity being supplied to the measurement device, altering an intensity of a light source of the measurement device, replacing the light source of the measurement device, replacing or repairing fiber optics, and altering a focus setting of the measurement device. In an additional embodiment, the method may include altering a characteristic of a window disposed within a polishing pad if one or more of the output signals are outside of the range. For example, altering a characteristic of a window may include, but is not limited to, altering surface conditions of the window such as roughness and scratches by conditioning, altering a thickness of the window, and replacing the window. Furthermore, the method may include determining if a specimen is present on the polishing pad above the window from the output signals.

In an alternative embodiment, output signals outside of the range may indicate damage to the specimen. Damage to the specimen may include, but is not limited to, damage to an uppermost layer formed on the specimen, breakage of an uppermost layer on the specimen, damage to multiple layers formed on the specimen, breakage of the specimen, and flexing of the specimen due to stress on the specimen during polishing. Output signals of a measurement device such as an eddy current device may be highly sensitive to such damage. Flexing of the specimen may also be determined using a commercially available system such as a Flexus system available from KLA-Tencor, Corporation, San Jose, Calif. The method may also include assessing damage to the specimen from one or more of the output signals determined to be outside of the range. For example, values of output signals that indicate damage to an upper layer formed on the specimen may be significantly different than values of output signals that indicate breakage of the specimen. Therefore, the values of the output signals outside of the range may be used to identify and/or eliminate one or more potential causes for the parameter of the measurement device to be outside of the control limits.

In addition, the method may include altering a parameter of polishing if one or more of the output signals are determined to be outside of the range. For example, polishing may be stopped to remove a damaged specimen from a polishing tool. In particular, polishing may be stopped to remove a broken specimen from a polishing tool since the broken specimen may create significant problems in a polishing tool, for example, by contaminating the polishing tool and/or damaging the polishing tool. The method may further include generating a signature characterizing polishing using output signals of a measurement device such as an eddy current device. In addition, the method may include determining if differences between the signature and a reference signature are outside of a range of the differences. Such differences may indicate that the specimen has been damaged.

In addition, the method may include generating an alert signal if one or more of the output signals are outside of the range. The alert signal may include any signal that may be detected by a user of the polishing tool. Such an alert signal may include a visual signal, such as a flag used to identify the characteristic or an alert message, or an audible signal, such as a warning alarm. The user may or may not-be located in a remote location from the polishing tool.

An additional embodiment relates to a method for determining a characteristic of a polishing pad. The method may include scanning the polishing pad with a measurement device such as an eddy current device or a capacitance probe to generate output signals at measurement spots on the polishing pad. For example, an eddy current device configured to scan a specimen during polishing may also be configured to move to a position under the polishing pad away from windows or openings in the polishing pad. Alternatively, the system may include an additional eddy current device positioned under the polishing pad away from windows or openings in the polishing pad. In this manner, the measurement device may be configured to scan the polishing pad.

The method may also include determining a characteristic of the polishing pad from output signals of the measurement device. For example, a processor as described herein may be configured to receive the output signals and to determine the characteristic. The characteristic may include a thickness-of the polishing pad, a composition of the polishing pad, a roughness of the polishing pad, and/or a rate of wear of the polishing pad. The method may also include determining variations in the characteristic across the polishing pad. The method may further include determining an approximate lifetime of the polishing pad from the characteristic. In addition, the method may include altering a parameter of a polishing tool in response to the characteristic to reduce the rate of wear of the polishing pad. Furthermore, the method may include altering a parameter of pad conditioning in response to the characteristic. For example, a parameter of pad conditioning may be altered such that variations in the characteristic across the polishing pad may be reduced by conditioning. A parameter of polishing or pad conditioning may be altered by a controller computer configured to receive the characteristic from the processor and to alter a parameter of polishing or pad conditioning.

Another embodiment relates to a method for determining a characteristic of a polishing tool. The method may include scanning a portion of the polishing tool with a measurement device such as an optical device, an eddy current device, or a capacitance probe to generate output signals at measurement spots on the portion of the polishing tool. For example, a measurement device configured to scan a specimen during polishing may also be configured to move to a position under a portion of the polishing tool such as a carrier ring. Alternatively, the system may include an additional measurement device positioned under the portion of the polishing tool. In this manner, the measurement device may be configured to scan the portion of the polishing tool.

The method may also include determining the characteristic of the polishing tool from the output signals. The portion of the polishing tool may include a carrier ring as described above. In this manner, the characteristic may include at thickness of the carrier ring. A thickness of the carrier ring may change over time due to contact with the polishing pad. As such, a rate of wear of the carrier ring may also be determined and may be used to estimate times at which the carrier ring may need to be replaced or repaired. In an embodiment, the polishing tool may also include multiple platens as described above. In such an embodiment, the method may include determining a characteristic of at least two of the multiple platens from the output signals and determining variations in the characteristic of the at least two multiple platens. For example, variations may be determined for multiple polishing heads and multiple carrier rings of a polishing system. As such, the method may be used to match multiple polishing units within a polishing tool or across multiple polishing tools.

Another embodiment relates to a method for characterizing polishing of a specimen. The method may include scanning the specimen with a first measurement device during a first step of the polishing process to generate output signals at measurement spots across the specimen as described above. The method may also include generating a first portion of a signature from the output signals. The first portion of the signature may include a singularity representative of an endpoint of the first polish step as described herein. In an embodiment, the method may include altering a parameter of the first polish step in response to the singularity to substantially end the first polish step and to begin the second polish step as described herein. In an additional embodiment, the method may include automatically stopping generation of the first portion of the signature in response to the singularity. In addition, the method may include scanning the specimen with a second measurement device during a second step of the polishing process to generate additional output signals at the measurement spots as described herein. The method may further include generating a second portion of the signature from the additional output signals. The second portion of the signature may include a singularity representative of an endpoint of the second polish step as described herein. Therefore, the method may include providing a single signature that includes signatures generated during individual polishing processes. In addition, the method may include any steps of other embodiments of methods as described herein.

Each, of the methods described herein may be implemented as an on-line process control tool or as an off-line process development tool. In addition, each of the methods described herein may be performed during other processes. For example, a presence of blobs on a specimen may be determined during a process that includes etching the specimen, cleaning the specimen, or any other process that involves removing material from the specimen. Etching the specimen may include wet etching or dry etching such as plasma etching and reactive ion etch ("RIE") etching, or any other etch process known in the art. Process tools configured to perform such etch processes are commercially available from Applied Materials, Inc., Santa Clara, Calif. Cleaning the specimen may include, but is not limited to, chemically assisted laser removal. An example of a chemically assisted laser removal tool is illustrated in "Chemically Assisted Laser Removal of Photoresist and Particles from Semiconductor Wafers," by Genut et al. of Oramir Semiconductor Equipment Ltd., Israel, presented at the 28$^{th}$ Annual Meeting of the Fine Particle Society, Apr. 1–3, 1998, which is incorporated by reference as if fully set forth herein. In addition, process tools that may be used to clean a specimen include tools commercially available from Novellus Systems, Inc., (Gasonics International Corporation), San Jose, Calif. and FSI International, Inc., Chaska, Minn.

In addition, each of the methods as described herein may further include fabricating a semiconductor device upon the specimen. For example, polishing as described herein may include polishing a layer of conductive material formed over an interlevel dielectric to form interconnects, contacts, vias, and/or other conductive structures within openings in the dielectric. After polishing, an additional layer may be formed across the specimen. The additional layer may be a conductive material and may be patterned using processes such as lithography and etch to form interconnects upon the polished layer. The polished layer may include contacts or vias electrically insulated by an interlevel dielectric. As such, the interconnects may be arranged upon the polished layer such that various contacts located within the polished layer may be connected. In addition, a dielectric layer may be formed upon the interconnects to electrically insulate the interconnects from one another. Such a dielectric layer may then be polished as described herein such that an upper surface of the dielectric layer may be substantially planar. Multiple such layers may be formed upon the specimen such that a plurality of semiconductor devices may be fabricated on the specimen.

A processor and a controller computer, as described herein, may be computer systems configured to operate software to perform one or more methods according to the above embodiments. The computer system may include a memory medium on which computer programs may be stored for controlling the system and processing signals from various components of the system. The term "memory medium" is intended to include an installation medium, e.g., a CD-ROM, or floppy disks, a computer system memory such as DRAM, SRAM, EDO RAM, Rambus RAM, etc., or a non-volatile memory such as a magnetic media, e.g., a hard drive, or optical storage. The memory medium may include other types of memory as well, or combinations thereof. In addition, the memory medium may be located in a first computer in which the programs are executed, or may be located in a second different computer that connects to the first computer over a network. In the latter instance, the second computer provides the program instructions to the first computer for execution. Also, the computer system may take various forms, including a personal computer system, mainframe computer system, workstation, network appliance, Internet appliance, personal digital assistant ("PDA"), television system or other device. In general, the term "computer system" may be broadly defined to encompass any device having a processor, which executes instructions from a memory medium.

The memory medium may be configured to store a software program for the operation of the system to perform one or more methods according to the above embodiments. The software program may be implemented in any of various ways, including procedure-based techniques, component-based techniques, and/or object-oriented techniques, among others. For example, the software program may be implemented using ActiveX controls, C++ objects, JavaBeans, Microsoft Foundation Classes ("MFC"), or other technologies or methodologies, as desired. A CPU, such as the host CPU, executing code and data from the memory medium may include a means for creating and executing the software program according to the methods described above.

Various embodiments further include receiving or storing instructions and/or data implemented in accordance with the foregoing description upon a carrier medium. Suitable carrier media include memory media or storage media such as magnetic or optical media, e.g., disk or CD-ROM, as well as signals such as electrical, electromagnetic, or digital signals, conveyed via a communication medium such as networks and/or a wireless link.

Further modifications and alternative embodiments of various aspects of the invention may be apparent to those skilled in the art in view of this description. For example, systems and methods for characterizing a polishing process are provided. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

What is claimed is:

1. A method for characterizing polishing of a specimen, comprising:

scanning the specimen with two or more measurement devices during said polishing to generate output signals at measurement spots across the specimen, wherein the two or more measurement devices comprise a reflectometer and a capacitance probe; and determining a characteristic of said polishing from the output signals.

2. The method of claim 1, wherein the capacitance probe comprises a conductive polymer probe.

3. The method of claim 1, further comprising determining if blobs are present on the specimen at the measurement spots using the output signals.

4. The method of claim 1, further comprising combining a portion of the output signals generated at the measurement spots located within a zone on the specimen, wherein said determining comprises determining the characteristic of said polishing within the zone from the combined portion of the output signals.

5. The method of claim 1, further comprising determining relative locations of the measurement spots on the specimen and generating a two-dimensional map of the characteristic at the relative locations of the measurement spots on the specimen.

6. The method of claim 1, further comprising determining absolute locations of the measurement spots on the specimen and generating a two-dimensional map of the characteristic at the absolute locations of the measurement spots on the specimen.

7. The method of claim 1, further comprising determining if the output signals are outside of a range of output signals, wherein output signals outside of the range indicate that a parameter of the measurement device is outside of control limits for the parameter.

8. The method of claim 1, further comprising determining if the output signals are outside of a range of output signals, wherein output signals outside of the range indicate damaging of the specimen.

9. A system configured to characterize a polishing process, comprising:

two or more measurement devices configured to scan a specimen during the polishing process to generate output signals at measurement spots across the specimen, wherein the two or more measurement devices comprise a reflectometer and a capacitance probe; and a processor coupled to the two or more measurement devices, wherein the processor is configured to determine a characteristic of the polishing process from the output signals.

10. A method for characterizing polishing of a specimen, comprising:

scanning the specimen with two or more measurement devices during said polishing to generate output signals at measurement spots across the specimen, wherein the two or more measurement devices comprise an optical device and an eddy current device;

determining a characteristic of a polishing pad used for said polishing from the output signals; and determining a characteristic of said polishing from the output signals.

11. A system configured to characterize a polishing process, comprising:

two or more measurement devices configured to scan a specimen during the polishing process to generate output signals at measurement spots across the specimen, wherein the two or more measurement devices comprise an optical device and an eddy current device; and a processor coupled to the two or more measurement devices, wherein the processor is configured to determine a characteristic of the polishing process from the output signals, and wherein the processor is further configured to determine a characteristic of a polishing pad used in the polishing process from the output signals.

12. The system of claim 11, wherein the optical device comprises a spectrophotometer.

13. The system of claim 11, wherein the optical device comprises a microscope based spectrophotometer coupled to a CCD camera.

14. The system of claim 11, wherein the optical device comprises a spectrophotometer, and wherein one or more of the measurement spots comprises an area on the specimen comprising at least two proximate structures having different optical properties.

15. The system of claim 11, wherein the optical device comprises a spectrophotometer configured to detect light reflected from the specimen at substantially zero-order.

16. A method for characterizing polishing of a specimen, comprising:

scanning the specimen with a measurement device during said polishing to generate output signals at measurement spots across the specimen, wherein the measurement device comprises a laser light source coupled to a first fiber optic bundle and a detector coupled to a second fiber optic bundle; and determining a characteristic of said polishing from the output signals; and combining a portion of the output signals generated at the measurement spots located within a zone on the specimen, wherein said determining comprises determining the characteristic of said polishing within the zone from the combined portion of the output signals.

17. The method of claim 16, wherein the measurement device further comprises lenses coupled to the first fiber optic bundle.

18. The method of claim 16, wherein the measurement device further comprises lenses coupled to the second fiber optic bundle.

19. The method of claim 16, wherein the first fiber optic bundle comprises a plurality of fiber optic elements, and wherein lenses are coupled to the fiber optic elements.

20. The method of claim 16, wherein the second fiber optic bundle comprises a plurality of fiber optic elements, and wherein lenses are coupled to the fiber optic elements.

21. The method of claim 16, wherein a first portion of the first fiber optic bundle is at an angle to a second portion of the first fiber optic bundle such that the first fiber optic bundle is configured to direct light from the laser light source to the specimen.

22. The method of claim 16, wherein a first portion of the second fiber optic bundle is at an angle to a second portion of the second fiber optic bundle such that the second fiber optic bundle is configured to direct light from the specimen to the detector.

23. The method of claim 16, further comprising determining if blobs are present on the specimen at the measurement spots using the output signals.

24. The method of claim 16, further comprising determining relative locations of the measurement spots on the specimen and generating a two-dimensional map of the characteristic at the relative locations of the measurement spots on the specimen.

25. The method of claim 16, further comprising determining absolute locations of the measurement spots on the specimen and generating a two-dimensional map of the characteristic at the absolute locations of the measurement spots on the specimen.

26. The method of claim 16, further comprising determining if the output signals are outside of a range of output signals, wherein output signals outside of the range indicate that a parameter of the measurement device is outside of control limits for the parameter.

27. The method of claim 16, further comprising determining if the output signals are outside of a range of output signals, wherein output signals outside of the range indicate damaging of the specimen.

28. A system configured to characterize a polishing process, comprising:

a measurement device configured to scan a specimen during the polishing process to generate output signals at measurement spots across the specimen, wherein the measurement device comprises a laser light source coupled to a first fiber optic bundle and a detector coupled to a second fiber optic bundle; and a processor coupled to the measurement device, wherein the processor is configured to combine a portion of the output signals generated at the measurement spots located within a zone on the specimen and to determine a characteristic of the polishing process within the zone from the combined portion of the output signals.

29. A method for characterizing polishing of a specimen, comprising:

scanning the specimen with a first measurement device during a first step of the polishing to generate output signals at measurement spots across the specimen;

generating a first portion of a signature from the output signals;

scanning the specimen with a second measurement device during a second step of the polishing to generate additional output signals at the measurement spots; and generating a second portion of the signature from the additional output signals.

30. The method of claim 29, wherein the first portion of the signature comprises a singularity representative of an endpoint of the first step.

31. The method of claim 29, wherein the first portion of the signature comprises a singularity representative of an endpoint of the first step, the method further comprising altering a parameter of the first step in response to the singularity to substantially end the first step and to begin the second step.

32. The method of claim 29, wherein the first portion of the signature comprises a singularity representative of an endpoint of the first step, the method further comprising automatically stopping said generating the first portion in response to the singularity.

33. The method of claim 29, wherein the second portion of the signature comprises a singularity representative of an endpoint of the second step.

34. A system configured to characterize a polishing process, comprising:

a first measurement device configured to scan a specimen during a first step of the polishing process to generate output signals at measurement spots across the specimen;

a processor coupled to the first measurement device, wherein the processor is configured to generate a first portion of a signature from the output signals;

a second measurement device configured to scan the specimen during a second step of the polishing process to generate additional output signals at the measurement spots; and wherein the processor is further coupled to the second measurement device, and wherein the processor is further configured to generate a second portion of the signature from the additional output signals.

35. A method for characterizing polishing of a specimen, comprising:

scanning the specimen with an eddy current device during said polishing to generate output signals at measurement spots on the specimen;

performing said scanning until a predetermined thickness of a film is detected on the specimen from the output signals, wherein the predetermined thickness is less than about 200 nm;

scanning the specimen with an optical device subsequent to detecting the predetermined thickness to generate additional output signals at the measurement spots on the specimen; and determining a characteristic of said polishing from the output signals and the additional output signals.

36. The method of claim 35, further comprising altering a parameter of said polishing subsequent to detecting the predetermined thickness to reduce a speed of said polishing during said scanning the specimen with the optical device.

37. The method of claim 35, further comprising determining an approximate endpoint of said polishing from the additional output signals.

38. The method of claim 35, wherein the optical device comprises a reflectometer.

39. The method of claim 35, wherein the predetermined thickness is less than about 80 nm.

* * * * *

UNITED STATES PATENT AND TRADEMARK OFFICE

CERTIFICATE OF CORRECTION

PATENT NO. : 6,884,146 B2
DATED : April 26, 2005
INVENTOR(S) : Lehman et al.

It is certified that error appears in the above-identified patent and that said Letters Patent is hereby corrected as shown below:

Title page,
Item [74], *Attorney, Agent, or Firm*, please delete "Ann Marie Mewhetter" and substitute therefor -- Ann Marie Mewherter --.

Signed and Sealed this

Twenty-second Day of November, 2005

JON W. DUDAS
*Director of the United States Patent and Trademark Office*